US007770317B1

(12) United States Patent
Tankersley

(10) Patent No.: US 7,770,317 B1
(45) Date of Patent: Aug. 10, 2010

(54) HANDGUARD SYSTEM WITH CLAMP DEVICE

(76) Inventor: Jerome Benedict Tankersley, 208 Braehead Dr., Fredericksburg, VA (US) 22401

( * ) Notice: Subject to any disclaimer, the term of this patent is extended or adjusted under 35 U.S.C. 154(b) by 294 days.

(21) Appl. No.: 12/214,930

(22) Filed: Jun. 24, 2008

(51) Int. Cl.
*F41C 23/16* (2006.01)

(52) U.S. Cl. ..... 42/71.01

(58) Field of Classification Search ..... 42/71.01, 42/72, 73, 74
See application file for complete search history.

(56) References Cited

U.S. PATENT DOCUMENTS

| | | | | |
|---|---|---|---|---|
| 2,933,843 | A * | 4/1960 | McFeeter | 42/85 |
| 2,951,424 | A | 9/1960 | Stoner | |
| 3,075,314 | A * | 1/1963 | Bakker | 42/71.01 |
| 3,090,150 | A * | 5/1963 | Stoner | 42/71.01 |
| 3,198,076 | A | 8/1965 | Stoner | |
| 3,348,328 | A * | 10/1967 | Roy | 42/73 |
| 3,939,589 | A * | 2/1976 | Tellie | 42/71.01 |
| 4,328,633 | A * | 5/1982 | Pachmayr et al. | 42/74 |
| 4,845,871 | A | 7/1989 | Swan | |
| 5,276,988 | A | 1/1994 | Swan | |
| 5,412,895 | A | 5/1995 | Krieger | |
| 5,945,626 | A | 8/1999 | Robbins | |
| 6,606,812 | B1 | 8/2003 | Gwinn | |
| 6,671,990 | B1 | 1/2004 | Booth | |
| 6,694,660 | B1 | 2/2004 | Davies | |
| 6,895,708 | B2 * | 5/2005 | Kim et al. | 42/72 |
| RE39,465 | E * | 1/2007 | Swan | 42/71.01 |
| 7,458,179 | B2 * | 12/2008 | Swan | 42/72 |
| 2006/0283318 | A1 | 12/2006 | Beaty | |

FOREIGN PATENT DOCUMENTS

| | | | |
|---|---|---|---|
| WO | WO2006/103062 | A1 | 10/2006 |

OTHER PUBLICATIONS

Bartoccci, Black Rifle II 2004, p. 119, The 9mm SMG Prototypes, Collector Grade Publications, Inc.,Coberg, Ontario, Canada.
Brownells Catalog #58, 2005-2006, pp. 296-297, laser sights, Brownells, Montezuma, Iowa, USA.
Brownells Catalog #60, 2007-2008, p. 383, laser sight, Brownells, Montezuma, Iowa, USA.
U.S. Appl. No. 60/734,193, Jerome B. Tankersley.
U.S. Appl. No. 11/593,439, Jerome B. Tankersley.
U.S. Appl. No. 11/975,881, Jerome B. Tankersley.

* cited by examiner

*Primary Examiner*—Bret Hayes

(57) ABSTRACT

In one embodiment, a handguard system with clamp device for use on a firearm. The firearm has a barrel, an operating member and a receiver. The barrel and operating member are joined to the receiver. The handguard system includes a barrel nut, a tubular handguard, a clamp device, and a low profile rail gas block. The barrel nut secures the barrel to the receiver and has an outer surface which lies inward of the operating member and engages the inner surface of the handguard. The handguard inner surface includes a groove for providing clearance to the operating member and gas block. The clamp device attaches to the handguard and includes an actuating screw and a spring loaded clamp pad which engages the barrel nut outer surface. The low profile rail gas block permits both interfacing accessories and rapid installation and removal of the handguard.

27 Claims, 12 Drawing Sheets

HANDGUARD SYSTEM WITH CLAMP DEVICE

CROSS-REFERENCE TO RELATED APPLICATIONS

PPA 60/734,193 and Ser. No. 11/593,439 and Ser. No. 11/975,881

FEDERALLY SPONSORED RESEARCH

None

SEQUENCE LISTING

None

FIELD OF THE INVENTION

This invention relates to handguards, and more particularly to floating handguard systems which interface accessories to M16 style firearms.

BACKGROUND OF THE INVENTION

Prior Art

The M16 rifle is a gas operated rifle adopted by the United States armed forces during the period 1962-63. Many variations have been produced since that time including civilian models for sporting uses.

The group of firearms generally considered "M16 style" includes gas operated rifles, and carbines with common design features including a barrel which attaches to the receiver with a barrel nut, a gas block, and an operating member such as a pushrod or gas tube which are part of the firearm operating mechanism.

Since the initial M16 development work, including U.S. Pat. No. 2,951,424 and U.S. Pat. No. 3,198,076 to Stoner, there has been ongoing innovation with regard to this firearm. Much of the work from about 1970 to 1995 has related to providing a more refined and durable version of the original design. During this period the iron sight aiming system and conventional non-floating handguards remained similar to the original technology for the majority of production.

Conventional handguards have primarily served the purpose of protecting the firearm user from contact with a hot barrel or operating part. These handguards contact the barrel at one or more locations and may conduct external forces to the barrel, adversely affecting accuracy. Floating handguards, well proven in competitive shooting activities, generally attach to the firearm receiver or barrel nut and do not touch the firearm barrel, thereby eliminating a potential source of firearm inaccuracy.

Furthermore, handguards that do not touch the barrel are less likely to conduct heat into the handguard, thus keeping handguard mounted components at a cooler temperature.

More recently there has been an accelerating trend towards interfacing an increasing number and variety of accessories to M16 style firearms, many of which are configured to mount to MIL-STD-1913 rails, which are dovetail rails with transverse slots, also called Picatinny rails, located on the handguard, receiver, and/or gas block. The similar Weaver rail is also employed, often in conjunction with MIL-STD-1913 rails on the same firearm.

For the purposes of this application, the terms "dovetail rail" or "rail" refer to both rail types. Since about 1995, many M16 style receivers, as depicted in this application, have a "flat top" design, with an integral dovetail rail along the receiver top portion.

In particular, aiming devices are proliferating and a rifle having four different sights, including optics, iron sights and lasers, is not uncommon. Sights formerly mounted to the most rigid part of the firearm, the receiver, have now overflowed to the handguard, which is usually a floating handguard.

Continuing innovations and device miniaturization will serve to increase the variety of complex, mission-specific, handguard mounted equipment for future firearm designs.

Thus, there is an emerging need for a firearm to have one or more alternately equipped handguards, coupled with a need to rapidly and precisely mount a handguard and its associated accessories to a user's firearm with minimum attention or adjustment of the various sighting devices by the user. This reduces firearms inventory and enables the user to retain a familiar weapon.

With regard to multiple firearm-mounted sighting devices, knowing that the devices have precise alignment or zero with the bullet path is of substantial importance in maintaining the user's confidence in the weapon.

Confirming zero, or "sighting-in" is best accomplished by test firing the weapon at a fixed target at the distance a sight is to be employed, which may require firing over a range of 50 to 600 yards. This can be impractical or impossible, particularly in a battle zone.

Presently, laser boresight devices are available which fit within the barrel bore or chamber and provide an adequate zero for shorter and intermediate ranges. They have the advantage that the weapon does not have to be fired to obtain zero, but the disadvantage that the weapon is temporarily disabled during this process as the bore is blocked by the boresight. Also, these laser boresights don't mount to a standard dovetail rail, making them single purpose devices. Thus, another need is an improved means for checking zero of the various firearm-mounted sighting devices.

Prior art includes a variety of approaches for mounting floating handguards to the M16 style firearm. In this regard, prior art gas blocks, particularly large configuration integral front sight and integral rail blocks, affixed to the barrel, have been an impediment to developing a rapidly installed and removed handguard.

Blocks of this style must be removed prior to installation or removal of most conventional floating handguards. A partial solution for many years has been the use of low profile gas blocks which have minimum structure, protrude minimally from the barrel surface, and have no secondary function, such as providing a front sight or dovetail rail.

Handguard systems which install longitudinally by sliding over the firearm barrel and engaging an unthreaded barrel nut outer surface have the potential for quick change or rapid installation and removal.

Prior art which relates to means for longitudinally installing a floating handguard to an externally unthreaded firearm barrel nut or nut assembly includes U.S. Pat. Nos. 5,412,415 Krieger, 6,671,990 Booth, 6,694,660 Davies and the applicants previous application Ser. Nos. 11/593,439 Handguard System and 11/975,881 Gas Block. The disclosures for each application cited immediately above are included in their entirety herein by reference.

As a handguard mounting concept, these prior art examples generally include a tubular handguard inner surface engaging an unthreaded outer surface of a barrel nut, and a barrel nut threaded inner surface securing the barrel to the receiver. The above cited examples of prior art include novel barrel nuts or nut assemblies, of either one or two part construction.

The handguard mounting concept just described appears to be straightforward, but a complicating factor is that an operating member such as a pushrod or gas tube, runs parallel to the barrel, slightly offset from the barrel, from a forward-located, barrel-mounted gas block back to the receiver, for cooperating with the firearm operating mechanism or action.

The operating member must be accommodated, that is, mechanical clearance provided for, by the barrel nut, or the handguard, or both.

The method of providing clearance for the operating member or gas tube varies among the different barrel nut-mounted handguard systems cited above with resulting implications for the configuration of the handguard and barrel nut.

In the case of the applicants previous application Ser. No. 11/593,439 Handguard System an example embodiment disclosed is a single piece tubular barrel nut with a threaded inner surface which clamps the barrel to the receiver, and a nut outer surface which lies between the gas tube and the barrel.

The tubular handguard includes an inner surface, which engages the outer surface of the barrel nut and also includes a longitudinal groove to provide clearance to the gas tube. A set screw provides a user-adjustable fit between the handguard inner surface and the barrel nut outer surface. A cross pin provides an alternate or redundant securing means.

Some M16 style firearms, such as submachine gun versions, do not have an operating member or gas tube and are blow-back operated by the explosion of the cartridge. Consequently, a handguard system for these non-gas operated versions, would not be required to provide clearance to an operating member such as a gas tube or pushrod.

The barrel nut mounted systems above, including the applicant Ser. No. 11/593,439 Handguard System, depend on a snug fit between the barrel nut outside surface and the handguard inner surface in order to accurately maintain point the of aim or zero of the firearm.

Conventional screws such as set screws or headed screws are one method of securing the handguard to the barrel nut, or manually adjusting for wear between the nut and handguard. For normal duty and with proper periodic tightening of the screws by the user, these systems have been able to perform satisfactorily.

However, given the current trend toward equipping a firearm with multiple high value sighting devices, including night vision equipment, and the need to maintain alignment or zero for these complex devices, preferably with minimal user invention, several disadvantages of the prior art become evident:

1. Screws bearing on metal surfaces, such as the aluminum, steel and composite materials often employed for the manufacture of barrel nuts and handguards, apply high force and a turning relative motion that is known to wear parts, in this case an expensive or hard to replace handguard or barrel nut.

Relative motion of any kind, including a wedging or camming action against a barrel nut or handguard can cause wear and loss of securing force.

2. Higher energy battle confrontations are becoming more the norm, rather than in the past when ammunition conservation was possible and prudent. Thus the firearm sees more heat in a short period of time, and differential expansion issues with different material types are amplified. Conventional screws can become loose under this dynamic thermal cycling.

3. Uncontrolled tightening of screw fastenings can be a problem in terms of damage to the screw or adjacent parts.

4. Installing and removing the handguard to and from the firearm is often a slow and laborious process.

This difficulty reduces the possibility of rapidly changing out a handguard, including its attached accessories, and installing another handguard with a different complement of accessories for a different mission, while the user retains the original familiar firearm.

5. If the firearm includes certain styles of gas block, such as integral front sight style or conventional integral rail style, the block may have to be removed prior to removal of the handguard, which prevents rapid change out of the handguard.

6. Prior art handguard systems don't provide the means to both rapidly remove and install a handguard and readily confirm sighting zero of the various devices, without either firing or disabling the weapon by utilizing a bore or chamber installed laser device.

It would be highly advantageous, therefore, to remedy these and other deficiencies within the prior art. The advantages of this handguard system with clamp device will become apparent after the consideration of the ensuing description and drawings.

SUMMARY

To overcome the foregoing disadvantages inherent in the prior art, provided are embodiments of a handguard system with clamp device for use on a firearm having a receiver, a barrel and an operating member such as a pushrod or gas tube. The barrel and operating member are joined to the receiver, and the operating member is offset from the barrel. In a basic example, the handguard system includes a barrel nut, a tubular handguard and a clamp device for securing the handguard to the barrel nut.

The barrel nut has an inner surface with a threaded portion adapted to threadably engage the receiver for securing the barrel to the receiver and an outer surface, the barrel nut outer surface disposed to pass between the operating member and the barrel.

The tubular handguard has an inner surface, and an outer surface, and a rear end, the tubular handguard surrounding the barrel, operating member, and barrel nut, engaging the barrel nut outer surface. The tubular handguard inner surface further includes a longitudinal groove for providing clearance to the firearm operating member.

The clamp device includes an actuating screw, a plate for mounting the clamp device to the handguard, and a clamp pad. The actuating screw includes a head, and an opposing screw end. The head has wrenching means and the screw has an external screw thread. The clamp plate has a plate thread for receiving the actuating screw thread, and means for attaching the plate to the handguard.

The handguard outside surface further includes a bore for receiving the clamp device, the bore located generally opposite the longitudinal groove, and near the handguard rear end. The handguard further has means for securing the plate to the handguard and the plate screw thread is aligned coaxially with the clamp bore.

The clamp pad has a top surface with a curvature matching the curvature of the barrel nut outer surface, the pad also having an opposing flat bottom surface, the bottom surface facing the plate and abutting the screw end. The pad further has a cross-sectional shape, relative to axis of the bore, adapted to permit the pad to slidably travel within the bore and orient the pad top surface to the barrel nut outer surface.

The clamp pad, forced by the actuating screw, engages and applies clamping force to the barrel nut outer surface when the actuating screw is advanced and tightened. The result is that the barrel nut outer surface is gripped between the clamp pad and the opposing handguard inner surface.

In another example, the handguard system clamp device is spring loaded. The spring is interposed between the actuating screw and the clamp pad. The spring maintains gripping force and prevents handguard misalignment caused by parts wear and extreme temperature variations, with minimal need for user intervention.

In a more detailed example, the handguard system, in addition to having a barrel nut, handguard, and clamp device, further includes an improved or low profile-integral rail gas block attached to the barrel, for mounting removable accessories such as an iron sight or laser sight, the laser sight suitable for providing a barrel-referenced alignment or zero of other firearm mounted sighting devices, while at the same time the gas block's low profile cross-sectional shape, resulting from locating the dovetail rail forward of the gas tube and close to the barrel, allows installation and removal of the handguard without first removing the gas block, and mounts accessories closer to the barrel, improving firearm handling.

The gas block is a single or unitary part having a rear face, the rear face having a first longitudinal bore extending forward through the block for receiving the firearm barrel and also a second longitudinal bore, offset above the first and extending forward for receiving the firearm gas tube or push rod.

The block further includes a vertical bore connecting the two longitudinal bores, the vertical bore being adapted to receive cartridge gas from a barrel gas port and convey the gas to the second longitudinal bore. The gas block has a bottom portion including means for securing the block to the firearm barrel.

The block further has a top portion, the top portion including the second bore and a Weaver or Mil-STD-1913 type dovetail rail, the rail located forward of the second bore and including an outward face. The forward location permits the rail to locate adjacent to the first bore, close to the barrel.

DRAWINGS

Figures

REFERENCE CHARACTERS

Like parts have like reference characters

Figure 1:
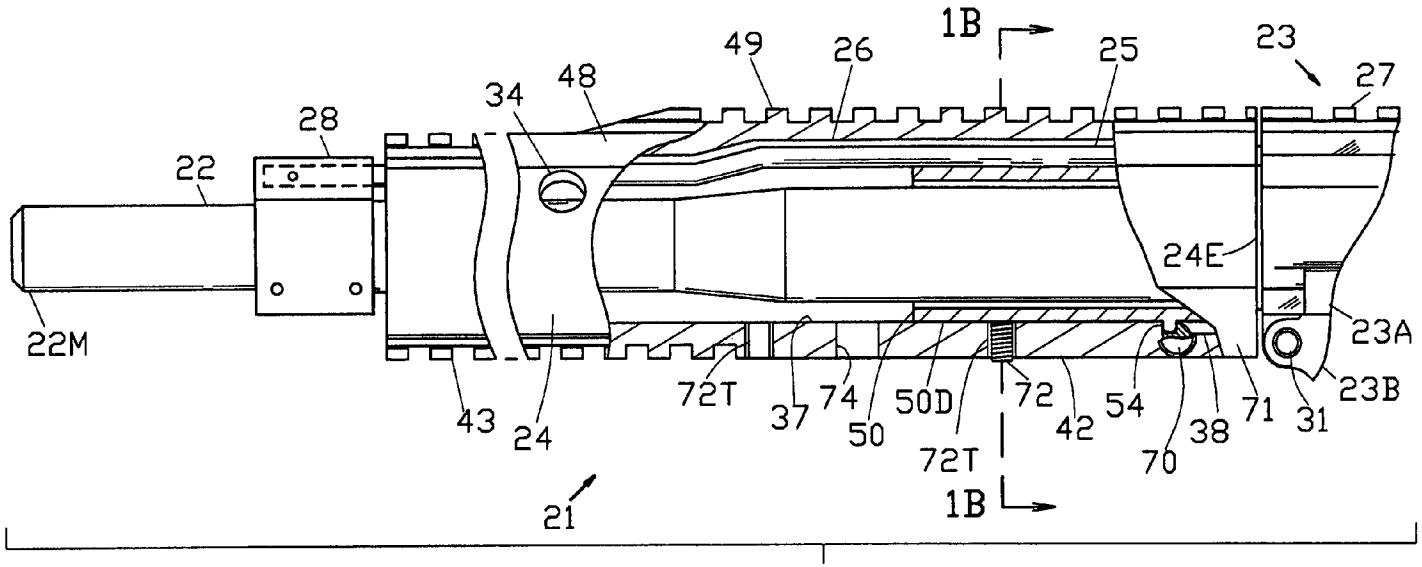
FIG. 1 is a side elevational view with partial sections of the handguard system of application Ser. No. 11/593,439 installed on a conventional M16 style receiver with top rail.

15—left projection, handguard; 15P—left pad 15F—left proj. face
16—right projection, handguard; 16P—right pad 16F—rt proj. face
17—plate tab; 17C—tab cavity
18—pad projection
19—mounting fasteners; 19T—thread apertures in handguard; 19A—apertures in plate
20—low profile—integral rail gas block
21—handguard system, prior art application '439
22—barrel; 22B—barrel bore; 22M—muzzle
23—flat top receiver, M16 style firearm
23A—upper receiver portion 23B—lower receiver portion 23F—receiver forward face
24—handguard of '439 application; 24A, 24B, 24C embodiments for present invention
24E—rear end of handguard 24
24R—rear end of 24C handguard
25—gas tube; 25P gas tube port
26—handguard clearance groove for gas tube
27—receiver rail 27L—left rec. rail wall 27R—rt rec. rail wall
28—low profile gas block
29—conventional M16 bolt carrier assembly
30—low profile—integral two rail gas block
31—receiver pin
32—upper rail
33—thrust washer 33H—washer hole
34—upper vent holes, plurality
35—pad post, long, 35A—pad post short
36—post hollow end 36F hollow end after flare
37—handguard inner diameter
38—second handguard inner diameter
39—handguard shoulder
40—actuating screw, Emb. 91 40E—screw end, screw 40 40Z—screw end, screw 40C
40A—actuating screw with hole, Emb. 92 40H is head of screw 40A
40B—screw with hole, and adjusting screw Emb. 93; 40C—small screw with hole, Emb. 94
40L—screw with hole, lever portion, Emb. 95; 40N—internal hex socket; 40×—head of 40C
41T—plate screw thread large; 41—plate screw thread, small; 41D—ext. screw thread, lg.
41M—external screw thread, small
42—bottom rib
43—bottom integral rail
44—pad, no post; 44A—pad, short post
44B—pad, long post; 44F—pad forward edge; 44R—pad rear edge
44S—pad top surface 44G—top surface mates with groove; 44P—pad bottom surf.
45—clamp bore
46—plate
47—first disc spring; 47H—hole in first disc spring
48—top rib
49—top rail
50—extended barrel nut; prior application '439
50D—nut outer diameter
51—bore slot, 51B blind slot
52—gap 0.03
53—gap 0.06
54—prongs
54F—prong forward face
54R—prong rear face
55—barrel nut, standard M16
56—top rib for embodiment 94, 95;
57—second disc spring, plurality; 57H—hole in second disc spring
58—barrel nut internal thread
59—annular shoulder
60—second style barrel nut, extended with groove; 60D—nut outer diameter
60E—forward pad edge; 60R—rear pad edge; 60G—groove dia. 60V—annular groove, nut
61—adjusting set screw; 61H—locking helicoil insert; 61D—head of screw 40B, Emb. 93
62—barrel flange
63—receiver barrel threads
64—65—retaining ring
66—plate, circular for emb 95; 66T—plate thin periphery
67—bore for plate 66
68—detent
69—detent spring
70—latch pin, handguard; 70A latch pin hole
71—enlarged portion of rib 42 or base; A,B,C variations for clamp devices

72—adjustment screw; 72T—threaded aperture
73—notch, in lever 76
74—bottom vent holes
75—latch surface
76—lever portion of screw 40L; 76N—narrow portion of 76
77—detent slot
78—slot, bolt carrier asm
79—relief, latch pin
80—alignment pins; 80A—aperture, pins
81—threaded aperture for 84
82—pushrod
83—84—set screw, gas block
85—rail top, gas block
86—rail bottom
87—block rear face
88—barrel nut inner surface; 88A—inner surface for nut with groove
89—gas port, barrel
90—projectile
91—clamp device, first embodiment-pad, large screw dia, blind slot/key
92—clamp device, second embodiment, pad/post, large screw, spring
93—clamp device, third embodiment, travel adjustment screw at actuating screw head
94—clamp device, fourth embodiment, small screw, thrust washer,
95—clamp device, fifth embodiment, small screw, (emb. 94 with lever on screw)
96—97—gas inlet hole, gas tube
98—hole thru actuating screws, 40A,B,C, L (lever)
99—circular screw head, screw 40L
100—101—handguard system first embodiment
102—handguard system second embodiment
103—handguard system third embodiment
104—handguard system fourth embodiment
105—handguard system fifth embodiment
111—laser sighting device
112—laser integral lever clamp
113—lower left bevel, gas block
114—lower right bevel, gas block
115—left upper bevel
116—left narrow portion, gas block
117 —right upper bevel
118—right narrow portion,
119—open
120—front handgrip accessory
121—first integral rail clamp optic
122—second integral rail clamp optic
123—iron sight, rear
124—stock
125—iron sight, front
126—iron sight integral cross bolt clamp
127—first bore,
128—second bore, gas block
129—vertical bore, gas block
130—M16 style firearm
132—alternate pad with flat surfaces
134—alt pad surface fits groove diameter, for pad 132
136—forward flat, pad 132
137—rear flat, pad 132
138—contact area, alternate pad 132
140—pad top surface forward
141—pad top surface rear
142—alternate pad, square configuration
143—pad surface, square pad 142
144—alternate pad with rib
146—forward face, square pad 142
147—rear face, square pad 142
148—contact area, square pad 142
150—rib curved surface for alternate pad 144
152—forward face, rib 156
154—rear face, rib 156
156—rib for pad 144
160—third barrel nut, for pad 144
160D—third nut outside diameter
160G—annular groove for nut 160

DETAILED DESCRIPTION OF THE INVENTION

The present invention combines prior details of the applicants previous application Ser. Nos. 11/593,439 and 11/975,881, with new elements, including clamp device embodiments, to provide novel and improved handguard system embodiments with advantages over the prior art. The disclosures of the above applications, in their entirety, are included herein by reference. Hereinafter application Ser. No. 11/593,439 will be called '439 Handguard System, and application Ser. No. 11/975,881 will be called '881 Gas Block.

For the purposes of this application, the term "M16 style" firearm refers to gas operated rifles and carbines with common design features and various designations including M16A2, AR15, M4 and AR10. However it is to be understood that other similar firearms could benefit from this invention.

Figure 1C:
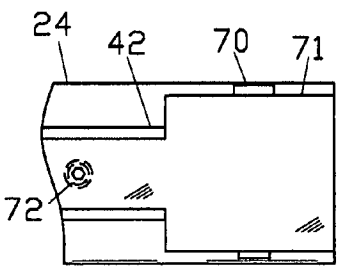
FIG. 1C is a partial bottom view of the handguard system of FIG. 1.

Referring now to the drawing figures where like reference characters indicate like parts throughout the various figures, FIGS. 1-1C show a handguard system embodiment 21, of previous application '439 Handguard System mounted to a portion of a conventional flat top M16 style receiver 23. FIG. 1 depicts additional conventional parts including a barrel 22, a gas tube 25, and a low profile gas block 28.

Prior art low profile gas blocks generally have a single function and a compact cross-sectional shape which permits a floating handguard to pass over them at installation and removal. Larger multifunction blocks such as an integral front sight type, and prior art rail blocks with the rail outward of the gas tube bore, as described in applicants '881 Gas Block generally must be removed before a floating handguard can be installed or removed.

Barrel 22 is joined to the forward portion of receiver 23, and gas block 28 is attached to barrel 22. Barrel 22 includes a muzzle 22M. Muzzle 22M defines a forward direction for the barrel and firearm in general. Gas tube 25, slightly offset from barrel 22, connects block 28 to receiver 23 and allows gases from a fired cartridge, not shown, to flow from barrel 22, through block 28 and rearward through tube 25 into receiver 23. The gas actuates a firearm operating mechanism or action, not shown.

M16 style receiver 23 is divided into an upper portion 23A and a lower portion 23B, and the two are generally fixed together with a forward pin 31 and a rear pin, not shown.

In FIGS. 1-1C, handguard system 21, the two primary elements are an extended barrel nut 50 and a handguard 24.

Figure 2A:
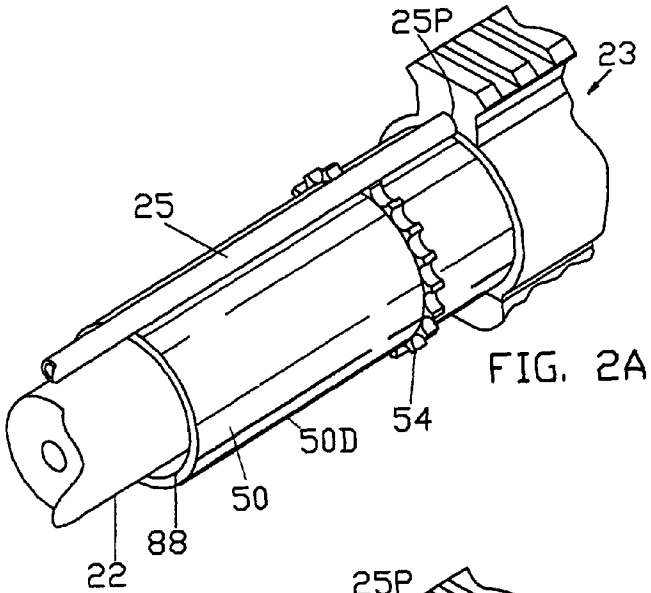
FIG. 2A is a front perspective view of an embodiment of the extended barrel nut of application Ser. No. 11/593,439 installed on a conventional M16 style receiver.
Figure 2C:
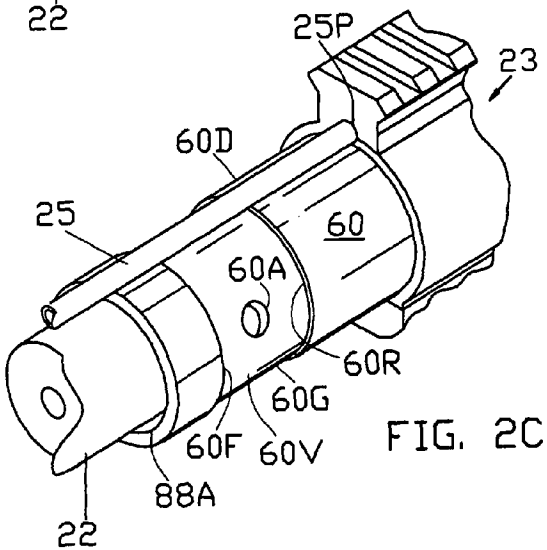
FIG. 2C is a front perspective view of an second type extended barrel nut of the present invention installed on a conventional M16 receiver.
Figure 2:
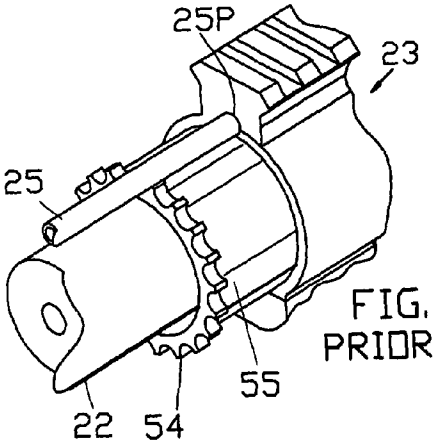
FIG. 2 PRIOR ART
FIG. 2 is a front perspective view of a conventional M16 barrel nut installed on a conventional M16 style receiver.

FIG. 2 shows, for reference purposes, a conventional M16 barrel nut 55, often used with earlier non-floating handguards, clamping barrel 22 to flat top receiver 23. FIGS. 2 A and 2B show extended barrel nut 50 of application '439 Handguard System, a single piece and having an elongated tubular shape, barrel nut 50 is further defined as having an inner surface 88 with a threaded portion 58 and an adjacent annular shoulder portion 59, adapted to threadably engage receiver threads 63. Annular shoulder 59 has a diameter smaller than diameter of nut threads 58.

When nut 50 is tightened, shoulder 59 urges a barrel flange 62 against receiver 23, for securing barrel 22 to receiver 23. For reference purposes, barrel 22 also has a projecting pin, not shown, engaging a receiver slot, not shown, to align barrel 22 rotationally with receiver 23. Nut 50 also has an outer surface with an outer diameter 50D, nut 50 outer surface disposed to pass between an operating member such as a pushrod or gas tube 25 and barrel 22.

Inner surface 88 is larger than the diameter of barrel 22 and does not contact barrel 22. Nut 50 further includes a plurality of prongs 54 around the periphery of nut outer diameter 50D. Prongs 54 are located at a predetermined distance along the nut length.

Prongs 54 allow clearance for an operating member such as gas tube 25, and also allow engagement of an armorer's wrench, not shown, for tightening nut 50. Handguard 24, referring again to FIGS. 1-1C, is a single piece and has a generally tubular shape. Handguard 24 has an inner surface with an inner diameter 37. Inner diameter 37 is slightly larger than barrel nut outer diameter 50D, and handguard 24 inner surface is further defined as having a longitudinal groove 26.

During handguard installation and removal, groove 26 provides clearance to operating member such as gas tube 25, and gas block 28. Handguard 24 inner surface is adapted to clear barrel 22, tube 25, and gas block 28, engaging barrel nut outer diameter 50D.

Continuing in FIGS. 1-1C to describe more details of handguard 24, a longitudinal top rib 48 extends forward a predetermined distance from a rear end 24E of handguard 24. A portion of rib 48 is formed into a dovetail rail 49, for mounting accessories, not shown.

Opposite rail 48, bottom rib 42 extends forward a predetermined distance from rear end 24E of handguard 24. A portion of rib 42 is formed into a bottom rail 43. Bottom rib 42 further includes a plurality of bottom vent holes 74 and threaded apertures 72T. A plurality of upper vent holes 34 are shown in FIG. 1. In cooperation with bottom holes 74, holes 34 allow ventilation of the handguard 24. Threaded apertures 72T permit mounting accessories which do not use rail clamp devices.

Figure 1B:
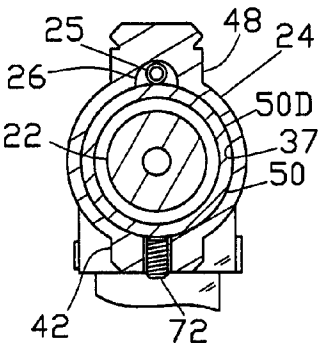
FIG. 1B is a section view of the handguard system of FIG. 1 taken at line 1B-1B.
Figure 1A:
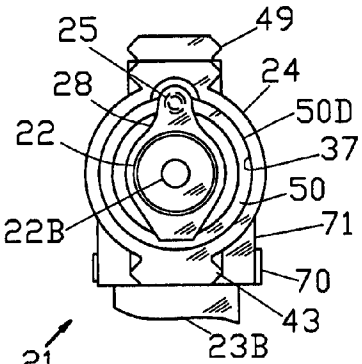
FIG. 1A is a front view of the handguard system of FIG. 1.

FIGS. 1 and 1B show an adjustment or set screw 72 engaging threaded aperture 72T.

Screw 72 allows the fit between barrel nut 50 and handguard 24 to be manually adjusted between a snug sliding fit to a fixed immovable fit, thus securing handguard 24 to barrel nut 50.

However, set screws are limited in that over time they can result in barrel nut wear. In addition they may not remain tight under extreme use and dynamic temperature conditions which can cause differential expansion or poor fit between parts, and require periodic user attention.

Figure 3A:
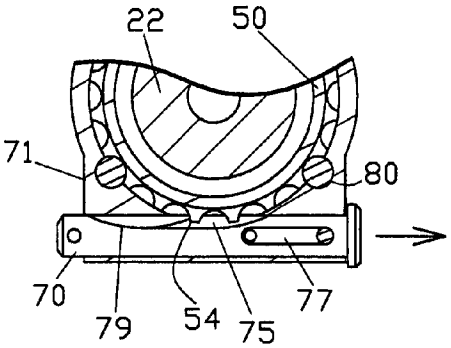
FIG. 3A is a front sectional view at line 3A-3A showing the latch pin in the latched position.
Figure 3C:
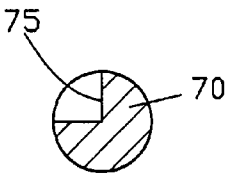
FIG. 3C is a sectional view of the latch pin taken at line 3C-3C, shown at enlarged scale.
Figure 3:
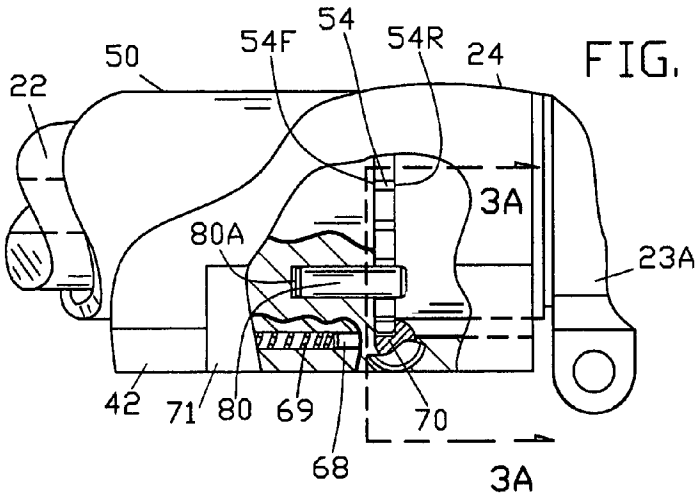
FIG. 3 is an enlarged side view with partial sections of the handguard system of application Ser. No. 11/593,439 showing alignment pins and a latch pin.
Figure 3B:
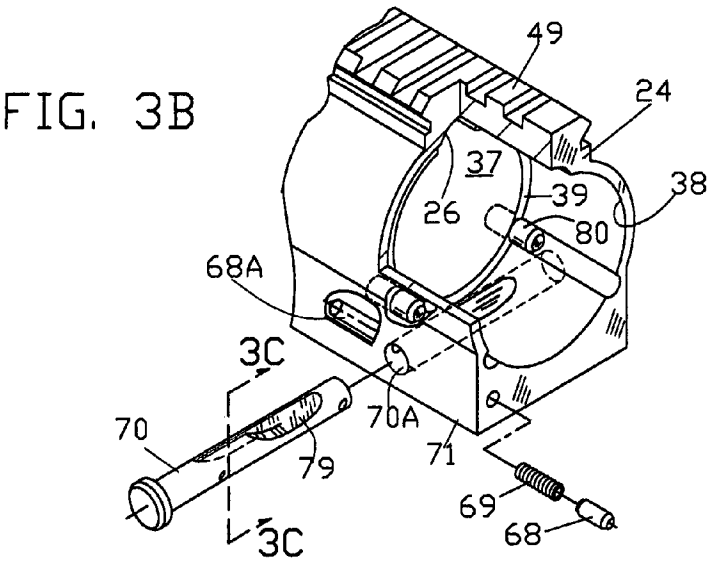
FIG. 3B is a rear perspective exploded view with partial sections of FIG. 3 shown at reduced scale.

FIGS. 1-1C and 3-3B show that adjacent to bottom rib 42 handguard 24 has an enlarged portion which forms a base 71. Base 71 has a generally rectangular cross section and includes a transverse aperture 70A, for receiving a latch pin, 70. In FIG. 3, shown are prongs front face 54F and rear face 54R. Aperture 70 A is disposed at a predetermined location to allow pin 70 to engage prongs rear face 54R when handguard 24 is installed on nut 50. Referring now to FIGS. 3-3B shown is a second handguard inner diameter 38. Inner diameter 38 provides clearance to prongs 54, and is concentric with diameter 37 and extends forward a predetermined distance, creating a handguard shoulder 39.

Shoulder 39 includes a pair of apertures 80A. Apertures 80 receive a pair of press-fit alignment pins 80. Pins 80 engage prongs 54 to prevent rotation of handguard 24 relative to receiver 23 and align handguard rail 49 with receiver rail 27.

Shown in FIGS. 3 and 3B, when handguard 24 is installed to barrel nut 50, shoulder 39 seats against prongs front face 54F, and pin 70, when pushed inward to the latched position shown in FIG. 3A, engages the prongs rear face 54R, thus latching handguard 24 to barrel nut 50. Viewing FIGS. 3A-3C, pin 70 includes a flat latch surface 75, for engaging prongs rear face 54R, a detent slot 77, and a relief 79.

Referring to FIG. 3A, to unlatch pin 70, it is pushed outward in the direction of the arrow until relief 79 aligns with prongs 54. This allows handguard 24 to slide forward along nut 50 and be removed from the firearm. A detent 68 and a detent spring 69 are received within a detent bore 68A in handguard 24. Detent 68 engages slot 77 to limit travel of latch pin 70.

The above descriptive information summarizes details of the '439 Handguard System application, and points out disadvantages of set screw 72 which may be used to manually control the fit between handguard 24 and barrel nut 50 as shown in FIG. 1.

The following descriptions will disclose how these details are combined with new members to provide new and improved handguard system embodiments.

DETAILED DESCRIPTION

First Embodiment

Figure 4:
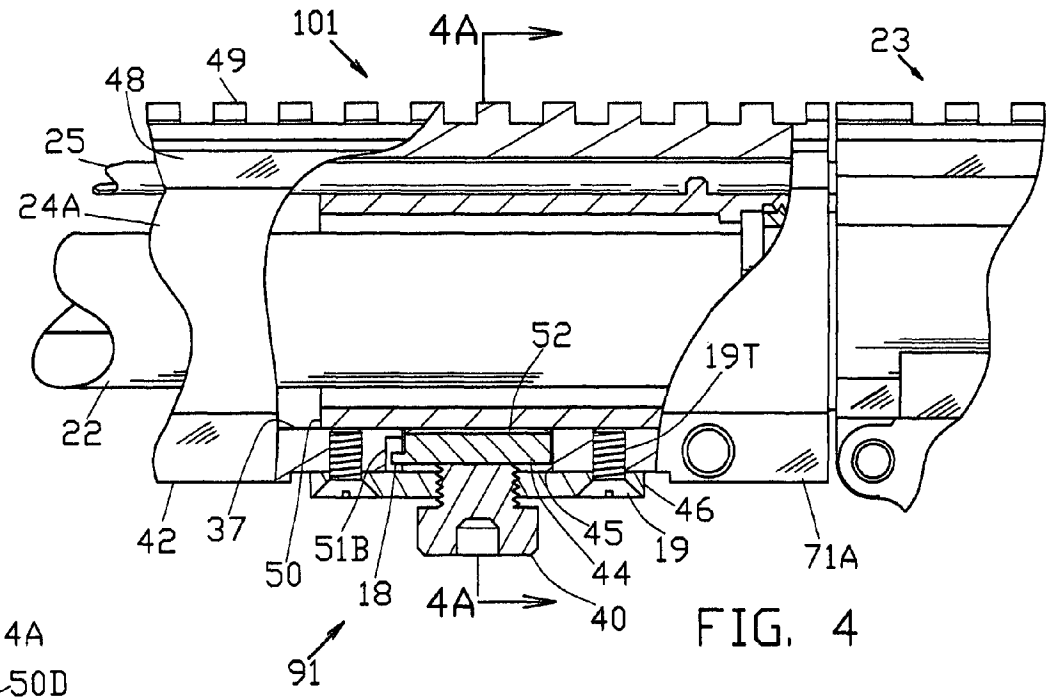
FIG. 4 is a side elevational view with broken out sections of a first handguard system embodiment of the present invention, with clamp device shown in unclamped position.
Figure 4C:
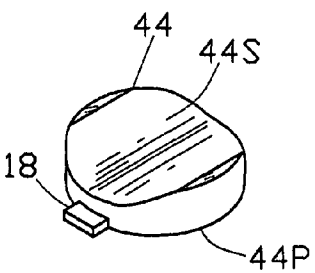
FIG. 4C is a perspective view of a first embodiment pad.
Figure 4B:
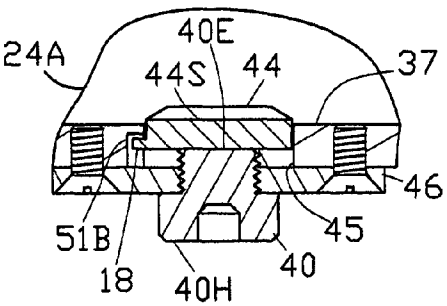
FIG. 4B is a sectional view at line 4B-4B showing the actuating screw and pad at maximum travel, screw seated against the handguard, handguard removed from barrel nut.
Figure 4A:
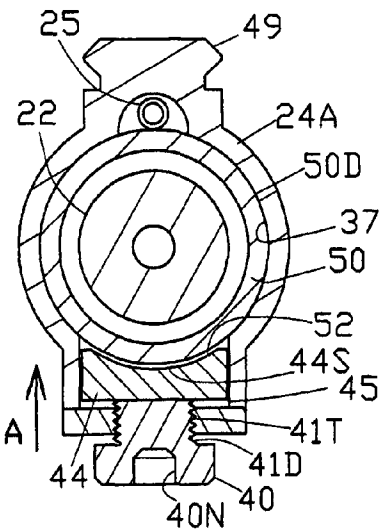
FIG. 4A is a sectional view of FIG. 4 at line 4A-4A with clamp device shown in unclamped position.

Moving now to a first embodiment of the present invention, FIGS. 4-4A show a handguard system 101, which includes a clamp device 91 instead of set screw 72 of FIG. 1.

Embodiment 101 is similar to system 21 of FIG. 1 in that barrel nut 50 secures barrel 22 to receiver 23. However, embodiment 101 includes a handguard 24A similar to handguard 24 except adapted to receive clamp device 91 instead of set screw 71.

Still considering FIGS. 4-4A, clamp device 91 includes an actuating screw 40, a pad 44, a plate 46, and a plurality of mounting fasteners 19. Clamp device 91 is shown in the unclamped position, with screw 40 and pad 44 positioned away from nut 50. A gap 52 separates pad 44 from nut diameter 50, and allows handguard 24A to slide longitudinally along nut diameter 50D for removal from or installation to the firearm.

Handguard 24A will now be described in more detail. Referring to FIGS. 4-4A, handguard 24A outer surface includes an enlarged portion or base 71A adjacent to bottom rib 42. Hand guard base portion 71A, includes an aperture or bore 45 for receiving clamp device 91, a blind slot 51 adjacent to bore 45, and a plurality of threaded apertures 19T. Bore 45 connects handguard 24A outside and inside surfaces, and is located opposite groove 26.

Figure 5B:
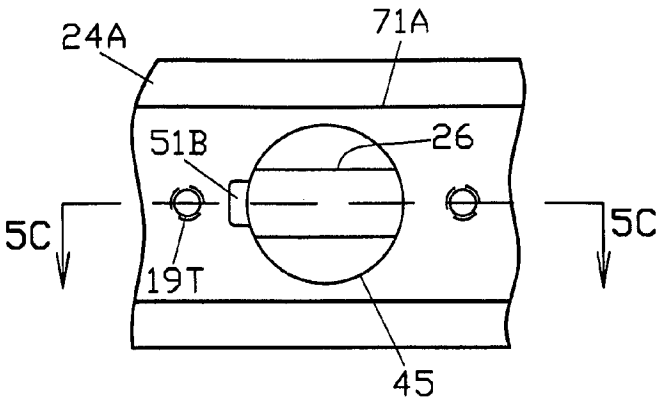
FIG. 5B is a bottom view of the handguard of FIG. 5 with the plate removed.

FIG. 5B shows a partial bottom view of handguard 24A, removed from the firearm, with plate 19 removed, showing base 71A, threaded apertures 19T, bore 45, and blind slot 51B. Bore 45 is configured to allow a sliding fit for clamp pad 44. Gas tube clearance groove 26 is visible through bore 45.

Figure 5C:
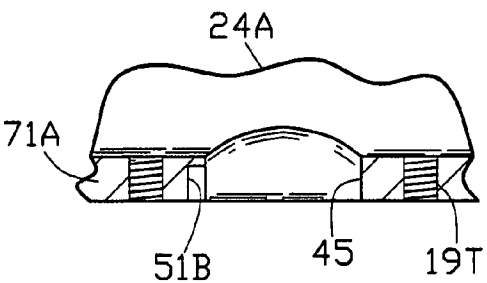
FIG. 5C is a partial sectional view the handguard of FIG. 5, taken at line 5C-5C.

FIG. 5C is a partial section view of handguard 24A taken at line 5C-5C showing threaded apertures 19T, bore 45 and blind slot 51B.

Figure 5:
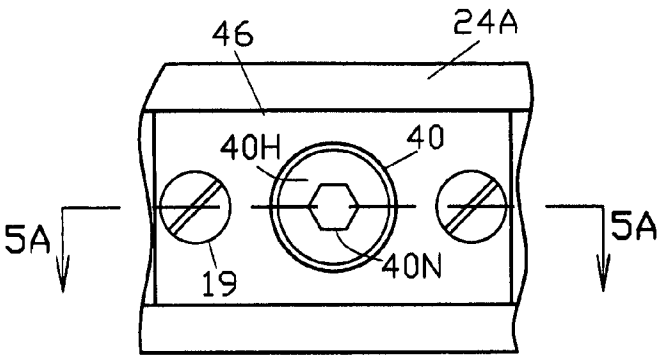
FIG. 5 is partial bottom view of the handguard system of FIG. 4 showing the plate and actuating screw.

Referring to FIGS. 4-4B and 5, continuing to describe the members of system embodiment 101, actuating screw 40 includes a screw thread 41D, a head 40H, an end 40E, and an internal socket 40N for driving screw 40, all shown in section in FIGS. 4-4B.

FIG. 5 shows screw 40 having head 40H and socket 40N. Socket 40N is shown configured to receive a hex key or hex bit driver, not shown, but other internal wrenching cavities or slots could be employed for the same purpose.

Figure 5A:
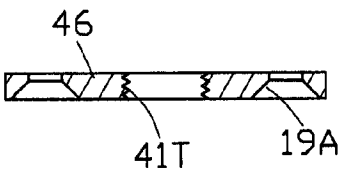
FIG. 5A is a sectional view of the plate of FIG. 5, taken at line 5A-5A.

Plate 46, in section, viewing FIGS. 4-4A and 5A, has a centrally located plate thread 41T, which is engaged by screw 40. Plate 46 also includes a pair of apertures 19A, shown in FIG. 5A for receiving a pair of plate mounting fasteners 19. Fasteners 19 attach plate 46 to handguard 24A at base 71A. In FIG. 5, plate 46 is seen in bottom plan view, attached to handguard 24A by fasteners 19.

Clamp pad 44, is seen in FIGS. 4-4C. FIG. 4C in particular, shows pad 44, in perspective view, as being generally disc-shaped, in this embodiment, with curved top surface 44S and a flat bottom surface 44P which abuts screw end 40E. Top surface 44S, mates with barrel nut outer diameter 50D, and thus has the same radius as diameter 50D, best seen in FIG. 4A.

Pad 44 further includes a radially extending projection 18 which engages blind slot 51B for both orienting surface 44S within bore 45 and retaining pad 44 within bore 45 whenever handguard 24A is removed from the firearm. This prevents the loss of pad 44 by falling from bore 45 into the interior of handguard 24A. Pad 44 could also have non-circular section, such as a square section for orienting curved top surface 44S with barrel nut diameter 50D, thus requiring a square bore in the handguard. This is discussed later in the specification, along with alternate means for securing the pad, handguard removed.

Barrel nuts, handguards and hardware parts for firearms, such as the pad, plate actuating screws, and other components of the present invention, are generally made from conventional steel, stainless steel, aluminum or composite material. Barrel nuts are usually machined from tube or bar stock, and handguards are usually cast, extruded, or fabricated by welding or other processes from tube and bar stock. Parts are often heat-treated to obtain proper strength and wear properties.

OPERATION

First Embodiment

In operation, considering system embodiment 101 in FIGS. 4-4A, handguard 24A is shown engaging barrel nut 50, but clamp device 91 is in the unclamped position.

To secure handguard 24A to nut 50, actuating screw 40 is tightened and advanced in the direction of arrow A, screw end 40E contacting and moving pad 44. Gap 52 which, as an example, may measure 0.030 inch unclamped, is reduced to zero during the tightening of screw 40. After tightening of screw 40, barrel nut 50 is firmly gripped between pad 44 and the opposing or upper part of handguard inner diameter 37 which is in contact with nut outside diameter 50D.

To ensure that nut 50 is firmly gripped, for this embodiment, screw head 40H does not contact plate 46 in the tightened position, not shown. For this simple, single stage clamping process, proper tightening, or applied torque, is user-controlled by either a torque wrench, or more often in practice, by operator "feel". For this embodiment, the purpose of head 40H is to prevent potential damage to handguard 24A with the handguard dismounted, as described below and shown in FIG. 4B.

FIG. 4B shows handguard 24A removed from the firearm with screw 40 fully advanced until head 40H seats against plate 46.

For this embodiment, with head 40H seated, it is desired that pad 44 intrudes inward beyond handguard inside diameter 37 to ensure that screw 40 has adequate length to clamp nut 50, but not so much length as to drive projection 18 into the bottom of blind slot 51B, thus damaging handguard 24A. Head 40H therefore acts as a stop, in this embodiment, to prevent over-driving screw 40.

An advantage of this first embodiment clamp device 91 compared to a prior art set screw or other device which bears directly on the barrel nut, with a high force relative motion, such as a cam or wedge, is that since pad 44 approaches nut 50 perpendicularly and without a rotating, relative motion with nut 50, and therefore wear of nut 50, is minimized as high clamping force is applied. Screw 40 and pad 44 are small, simple parts of steel or other wear-resistant material, which can be readily hardened against wear.

Another advantage of clamp device 91 is that the area of pad surface 44S is substantially larger than a conventional set screw end or cam linear contacting surface, and thereby puts relatively low stress on barrel nut 50, at the same time allowing high clamping forces.

Second Embodiment

Figure 6:
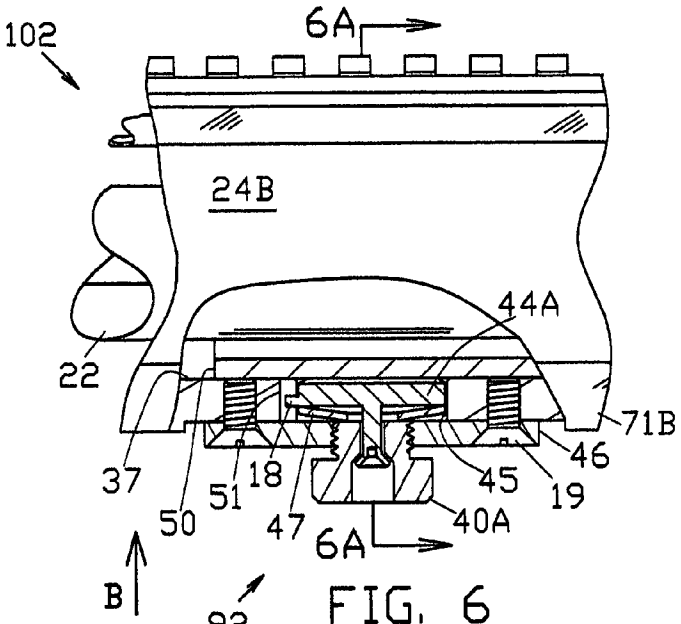
FIG. 6 is a side view with broken out sections of a second handguard system embodiment of the present invention, with clamp device shown in unclamped position.
Figure 6F:
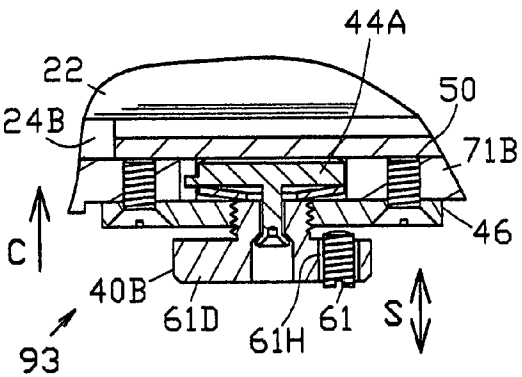
FIG. 6F is a side view with broken out sections of a third handguard system embodiment with the clamp device shown in unclamped position, and having adjustable screw travel.
Figure 6C:
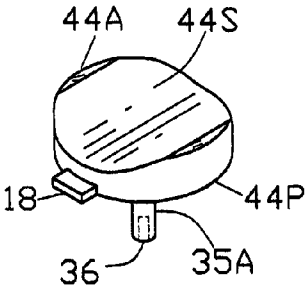
FIG. 6C is a perspective view of a second embodiment pad, showing post with hollow end.
Figure 6D:
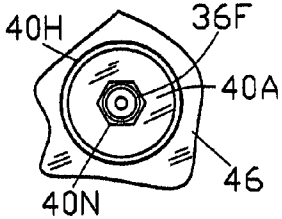
FIG. 6D is a partial bottom view of FIG. 6 showing plate and actuating screw.
Figure 6E:
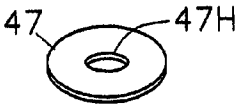
FIG. 6E is a perspective view of a first clamp spring.

FIGS. 6-6E show another handguard system embodiment designated 102, which includes a clamp device embodiment 92. Clamp device 92 is similar to device 91 but clamp device 92 is spring loaded. Handguard 24B is similar to handguard 24A of first embodiment 91 but has a base portion 71B with bore 45 and a through slot 51, for receiving clamp device 92.

New elements within device 92 include an actuating screw 40A, a pad 44A, and a spring 47. Spring 47 is interposed between screw 40A and pad 44A.

Actuating screw 40A is similar to screw 40, having an internal socket 40N, but screw 40A includes a through-hole 98, hole 98 coaxial with screw threads 41D.

Pad 44A is similar to pad 44 having curved top surface 44S, and projection 18, but pad 44A includes a centrally located cylindrical post 35A projecting downward from bottom surface 44P. Cylindrical post 35A has a diameter slightly smaller than screw through hole 98, allowing free passage to post 35A. Post 35A includes a lower hollow end 36.

Spring 47 is depicted in FIGS. 6 and 6E as a disc spring, although other spring types such as a flat spring could be employed. Disc springs, also called Belleville washers, generally made of steel or stainless steel, have a central hole and a raised or domed shape when at rest or unloaded, and may be deflected flat at full load. Stacking the springs in various configurations, as described in supplier literature, allows varying the applied load. Spring 47 includes a central hole 47H.

Disc springs are available from MSC Industrial Supply Co. at 800.645.7270.

Figure 6A:
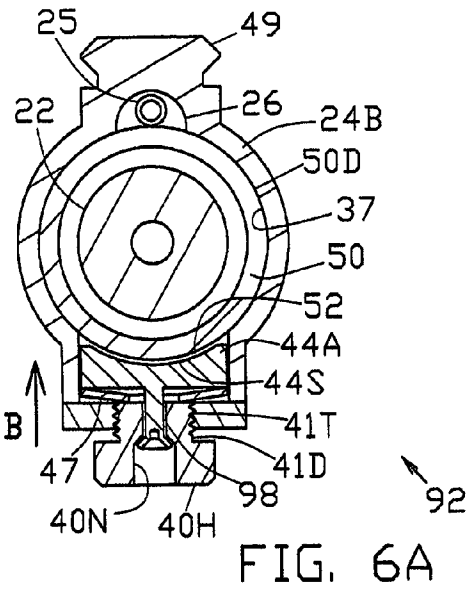
FIG. 6A is a section view of FIG. 6 taken at line 6A-6A with broken out sections showing clamp device in the unclamped position.

Post 35A of pad 44A serves three purposes:

(1) Post 35A provides a unitized clamp device assembly at manufacture. Viewing FIGS. 6-6A, with screw 40A threaded into plate 46, spring 47 is installed onto post 35A of pad 44A, then post 35A is inserted through hole 98 of screw 40A.

Figure 6B:
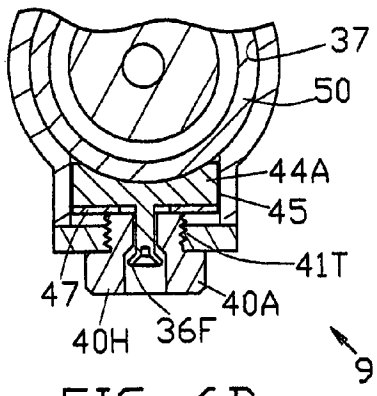
FIG. 6B is the section view of FIG. 6A, but showing the clamp device in the clamped position.

With the clamp parts oriented in a fixture, not shown, post hollow end 36 is flared to shape 36F shown in FIG. 6B, thus unitizing the clamp device parts. Conventional riveting or swaging machines, not shown, perform this operation.

(2) Post 35A, linking pad 44A with screw 40A serves the second purpose of providing positive retraction and positioning of pad 44A when unclamping.

(3) A third purpose served by linking pad 44A to screw 40A is that both pad 44 and screw 40A are retained to each other and to handguard 24B, thereby avoiding parts loss. Blind slot 51B may be replaced with through slot 51 since it is not needed to retain pad 44A.

Second Embodiment

For system embodiment 102, the clamping process is significantly different, as described below, than that for embodiment 101. Shown in FIGS. 6-6A, handguard 24B with clamp device 92 are installed to barrel nut 50 and device 92 is in the unclamped position with gap 52 separating pad 44A from nut diameter 50D. Spring 47 is in an unloaded or free position.

To secure handguard 246 to nut 50, actuating screw 40A is advanced in the direction of arrow B and tightened. Unlike embodiment 101, this clamping process is a two-stage process. First, tightening and advancing screw 40A elevates both pad 44A and spring 47 until pad surface 44S contacts nut diameter 50D. Consequently, gap 52 which, as an example, may measure 0.030 inch unclamped, is reduced to zero, as seen in FIG. 6B.

In the second stage of clamping, continued advance of screw 40A begins to compress and load spring 47 which transmits its force to pad 44A. Unlike embodiment 101, force applied to pad 44A, during clamping, is positively controlled and limited by screw head 40H contacting plate 46 as shown in FIG. 6B which depicts the clamped position. Although shown flat, in practice, spring 47 and other springs of this type are often only partially compressed when loaded. In FIG. 6B, if screw 40A had a shorter length of thread, spring 47 would not be flattened, and would apply a reduced force, if desired, to pad 44A.

In this second embodiment, total travel of screw 40A during the two stage clamping process includes closing gap 52 and compressing spring 47. An example of travel distances is 0.030 inch to close gap 52 and 0.040 inch to compress spring 47 for a total screw travel of about 0.070 inch. When screw 40A travel is stopped with head 40H seated against plate 46 as shown in FIG. 6B, barrel nut 50 is firmly gripped between pad 44A and the upper portion of handguard inner diameter 37 which is in contact with nut outer diameter 50D.

If a sudden external event such as a rapid thermal expansion of handguard 24B would move screw 40A slightly outward, away from pad 44A, gripping force would not be lost, but temporarily reduced as spring compression is reduced.

This second embodiment thus has the low stress and wear advantages of first embodiment 101 and additionally provides a clamp device in the form of a unitized subassembly, which dynamically or self-maintains gripping force during external thermal events.

Another advantage is that positive retraction of pad 44A, during unclamping, is accomplished. Another advantage is that pad 44A and screw 40A are retained to each other and to handguard 24A, preventing loss.

DETAILED DESCRIPTION AND OPERATION

Third Embodiment

FIG. 6F shows a slightly different embodiment of clamp device 92, designated as clamp device 93. Device 93 is shown in the unclamped position. Clamp device 93 is similar to device 92 but includes an actuating screw 40B. Screw 40B includes a larger head 61D, which has a locking helicoil insert 61H for receiving an adjustment screw 61. The axis of insert 61H is parallel to the axis of actuating screw 40B. Screw 61 can be adjusted in the directions shown by arrow S to protrude from head 61D as desired.

When actuating screw 40B is tightened in the direction of arrow C, as when securing handguard 24B to barrel nut 50, adjustment screw 61, depending on its adjustment, contacts plate 46, thus limiting the travel of actuating screw 40B, thus limiting the deflection and force applied by spring 47 to pad 44A. Locking helicoil insert 61H locks adjustment screw 61 at the desired setting. Consequently, the gripping force that clamp device 93 applies to barrel nut 50 can controlled by the user.

Fourth Embodiment

Figure 7:
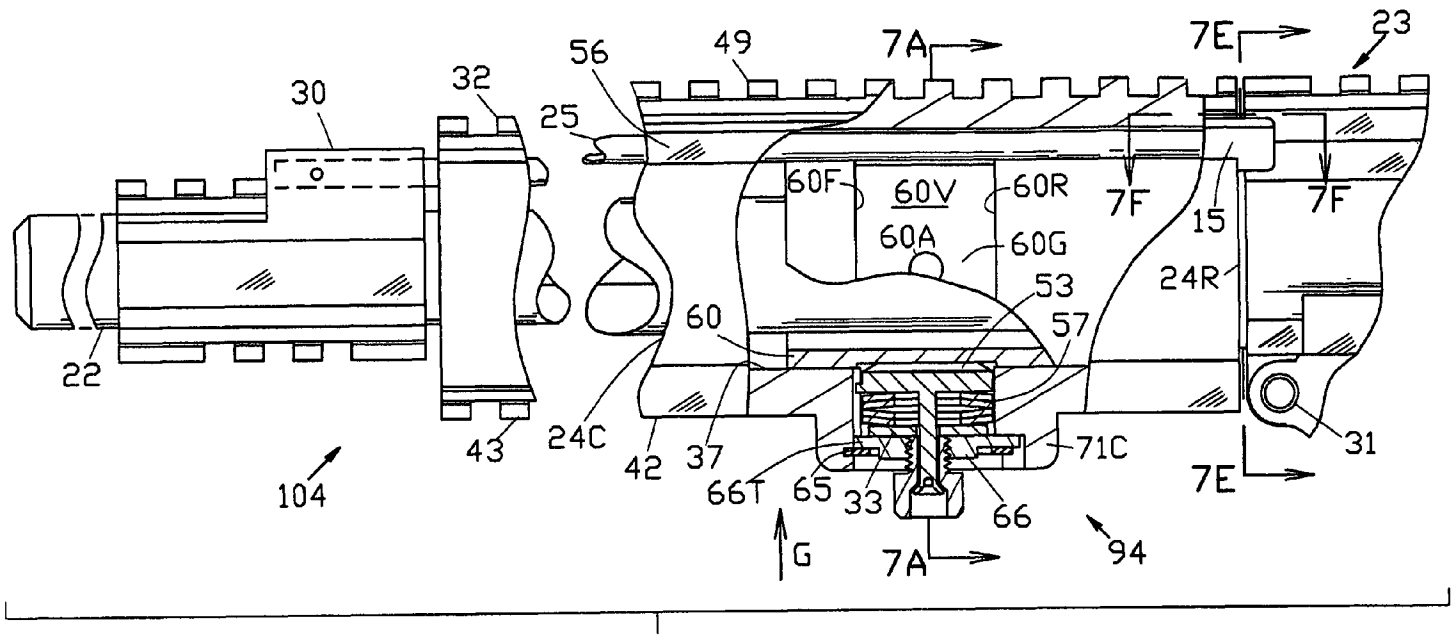
FIG. 7 is a side view with broken out sections of a preferred handguard system embodiment, showing the clamp device, including a thrust washer, in unclamped position.
Figure 7B:
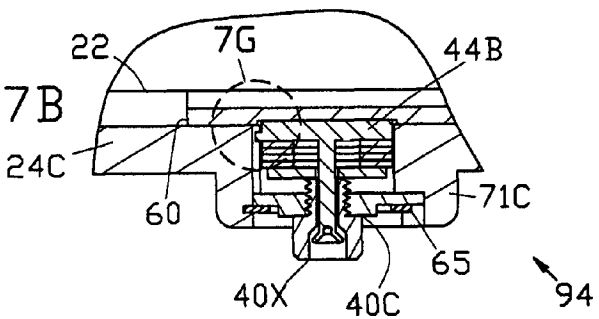
FIG. 7B is a side elevational view with broken out sections of the embodiment of FIG. 7 with the clamp device in the clamped position.
Figure 7A:
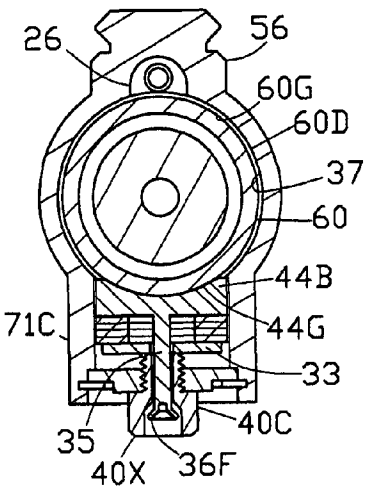
FIG. 7A is a section view of FIG. 7 taken at line 7A-7A, showing the clamp device in the clamped position.

FIGS. 7 and 7A show another handguard system embodiment 104 which differs from embodiment 102 in that it includes a second style extended barrel nut 60, a handguard 24C, a clamp device embodiment 94, and an improved gas block 30 from the applicant's previous '881 Gas Block application Second extended barrel nut 60, which is also shown in FIG. 2C for comparison with previous barrel nuts, and referring again to FIG. 2B, has the same internal thread 58 and shoulder 59 configuration for clamping barrel 22 to receiver 23 as nut 50. Barrel nut 60 also has an outer surface with an outer diameter 60D, an annular groove 60V with a groove diameter 60G, and an aperture 60A. When groove diameter 60G is formed to a predetermined depth relative to nut outer diameter 60D, as an example 0.030 inch, a forward and rear groove shoulder 60F and 60R are formed. Aperture 60A has a predetermined location and depth on the outer surface of nut 60, which allows the engagement of a spanner wrench, not shown, for tightening nut 60.

Figure 2B:
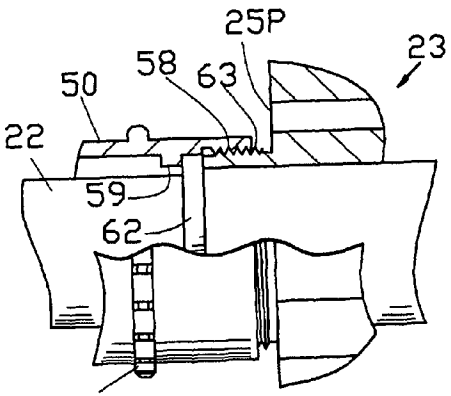
FIG. 2B is a side elevational view, with partial sections, in enlarged scale, of the barrel nut of FIG. 2A.

Second nut 60 does not have the prongs 54 (for alignment pin engagement) of nut 50, FIGS. 2A-2C, and thus other means to prevent handguard rotation relative to receiver 23 must be provided, as described below. Further, since nut 60 does not have prongs 54, handguard second inner diameter 38 is not required in handguard 24C, described below.

Viewing FIGS. 7-7A, handguard 24C is similar to previous handguards described herein, but is adapted to receive clamp device 94. Another difference is that handguard 24C which has a rear end 24R, also includes a second style top rib 56 which is formed into top rail 49 and forward upper rail 32. In an alternate embodiment, top rail 49 could extend full length of handguard 24C, eliminating rail 32. This is desirable for extruded manufacture of handguard 24C.

Top rib 56 extends rearward beyond rear end 24R of handguard 24C, forming a left and a right projection 15 and 16, shown in FIGS. 7, 7D, 7E and 7F. Projections 15 and 16 extend a predetermined distance from end 24R, and interface with receiver 23 for the dual purpose of locating handguard 24C longitudinally and preventing rotation of handguard 24C relative to receiver 23.

Figure 7E:
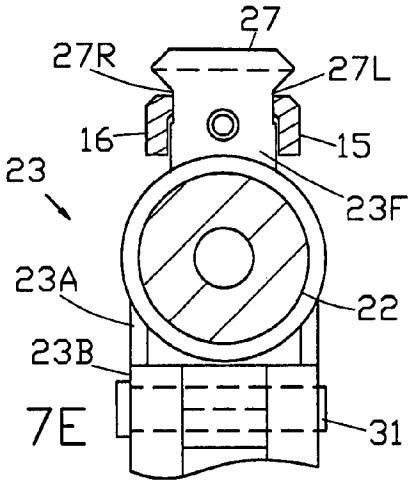
FIG. 7E is a section view of FIG. 7 taken at line 7E-7E showing the long portion of the projections engaging the firearm receiver.
Figure 7D:
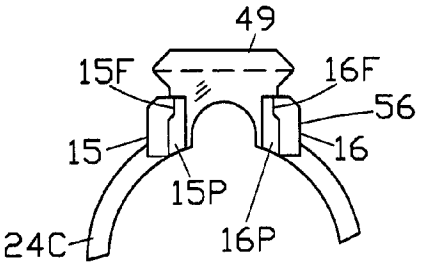
FIG. 7D is a partial rear end view of the handguard of FIG. 7, showing left and right projections.
Figure 7F:
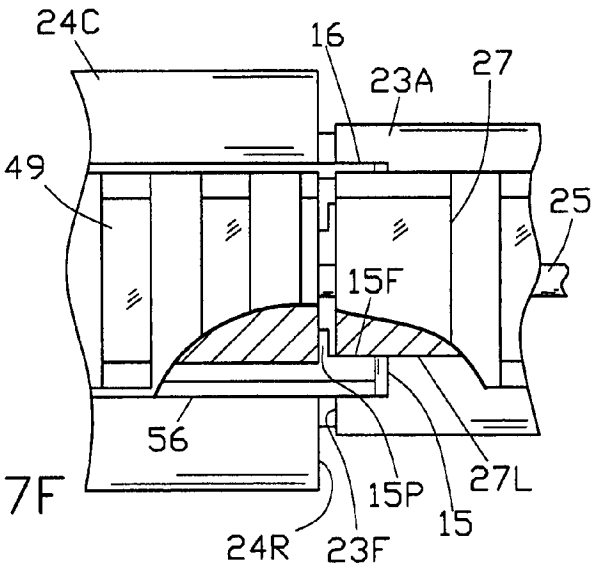
FIG. 7F is a partial enlarged top view of FIG. 7 with broken out sections taken at line 7F-7F showing the engagement of the projections with the receiver rail and front face.

Viewing FIGS. 7E-7F, conventional flat top M16 style receiver 23 includes receiver top rail 27, a pair of receiver rail walls 27L and 27R, and a front receiver face 23F. Projections 15 and 16, each include a short portion or pad 15P and 16P. Pads 15P, 16P by having an abutting or near-abutting relation to receiver face 23F, serve to locate the handguard longitudinally so that clamp pad 44B will readily locate and clamp within the width of groove 60V.

Referring to FIGS. 7D-7F, projections 15, 16 each have an inward face 15F and 16F, the faces lying in a vertical plane, the faces 15F, 16F further defined as abutting or engaging respective receiver rail walls 27L and 27R, thereby preventing rotation of handguard 24C with respect to receiver 23, specifically upper receiver 23A.

Figure 7C:
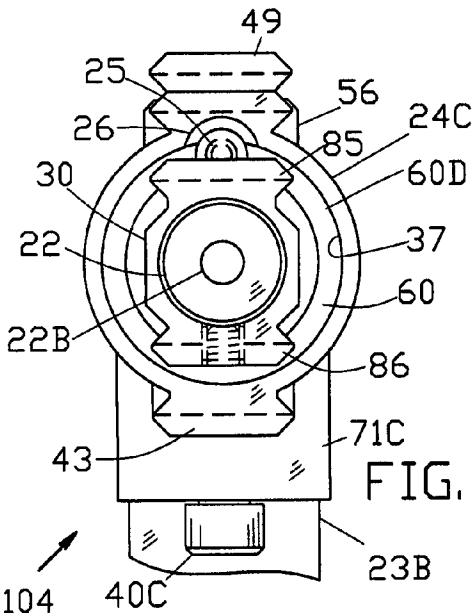
FIG. 7C is a front end view of the handguard system of FIG. 7.

FIG. 7C, a front end view of embodiment 104, shows that handguard 24C and low profile rail gas block 30 cross-sectional shapes cooperate to allow handguard 24C to pass over gas block 30 during handguard installation and removal. Unlike prior art integral-rail gas blocks which have the top rail mounted outward of the block longitudinal bore for the gas tube or pushrod operating member, the forward top rail position of improved gas block 30 allows the rail to be located close to barrel 22, thereby permitting handguard 24C to install or remove to the firearm without removing block 30.

Figure 8A:
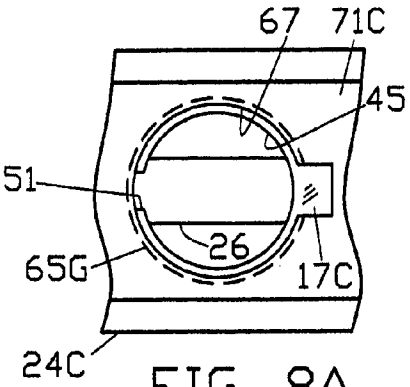
FIG. 8A is a bottom view of the handguard of FIG. 7 with the clamp device removed.
Figure 8B:
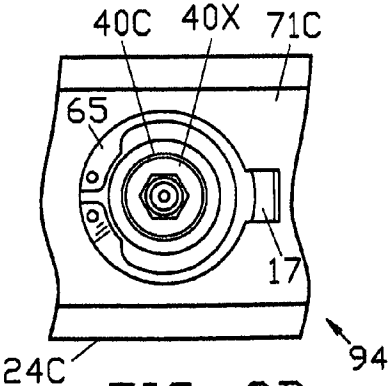
FIG. 8B is a bottom view of the clamp device of FIG. 7
Figure 8:
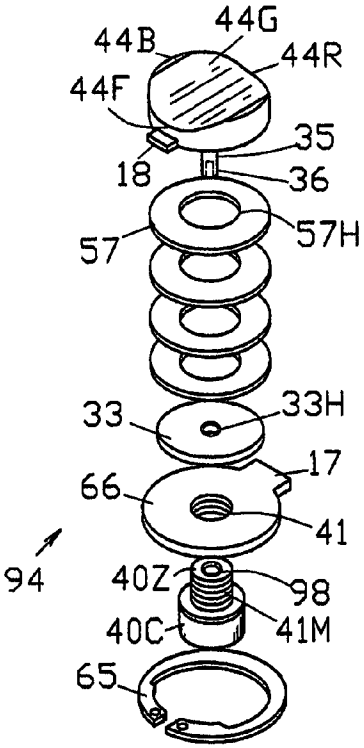
FIG. 8 is an exploded view of the clamp device of FIG. 7, shown in reduced scale.

Regarding clamp device 94, it can be best understood if FIGS. 7-7B and 8 are considered together. FIG. 7 shows device 94 installed into handguard 24C, in the unclamped position. FIG. 7A is a section taken at line 7A-7A showing device 94 in the clamped position. FIG. 7B is a broken out section side view showing device 94 in the clamped position.

Clamp parts are best seen in FIG. 8, an exploded perspective view of device 94 which shows a pad 44B, a plurality of second style disc springs 57, a thrust washer 33, a circular plate 66, a small actuating screw 40C, and a retaining ring 65. Circular plate 66 and retaining ring 65 permit a simplified mounting.

Pad 44B includes a different curved top surface 44G, the curvature matching groove diameter 60G, for mating with groove 60G, a forward edge 44F, a rear edge 44R, a post 35 with hollow end 36. Disc spring 57 includes a larger central hole 57H compared to spring 47. Thrust washer 33 includes a central hole 33H. Circular plate 66 includes a central threaded hole 41 and a projecting tab 17. Small actuating screw 40C includes a screw thread 41M, a head 40X, an opposing end 40Z and a through hole 98.

In this embodiment, unlike the previous embodiment examples, the diameter of thread 41M of screw 40C is smaller than hole 57H of spring 57. Therefore, thrust washer 33 is provided, interposed between end 40Z of screw 40C and springs 57, to transfer force from screw 40C to springs 57. Hole 33H in washer 33 provides passage for pad post 35.

In a manner similar to that for embodiment 92, clamp embodiment 94 may be unitized as a subassembly, referring to FIG. 7, by threading screw 40C into plate 66, stacking disc springs 57 and thrust washer 33 onto pad post 35, inserting post 35 into screw through hole 98, fixturing the assembly, not shown, to properly position the parts and then flaring the hollow end 36 of pad 35. After flaring, the hollow end 36 of pad 44B is designated 36F as seen in FIGS. 7-7A.

FIG. 8A is a partial bottom view of handguard 24C showing bore 45 and a plate bore 67 into base 71C of handguard 24C, a retaining ring groove 65G concentric with bore 67, a tab cavity 17C, slot 51 and gas tube clearance groove 26.

Viewing FIG. 7, to conclude securing clamp device 94 to handguard 24C, plate 66 with attached parts is inserted into plate bore 67, with tab 17 aligned with tab cavity 17C. As in similar embodiments, bore 45 provides a sliding fit for pad 44B. Retaining ring 65 is installed into groove 65G to secure the clamp device. As shown in FIG. 7, circular plate. 66 includes a thin peripheral portion 66T, to provide clearance for ring 65.

FIG. 8B shows a partial bottom view of device 94 installed into handguard 24C. Retaining ring 65 is installed, tab 17 is seated into cavity 17C, and head 40X of actuating screw 40C is shown in end view.

FIGS. 7, 7C, 12-12C and 13 depict embodiments of the applicants previous application '881 Gas Block which describes an improved or low profile-integral rail gas block which allows the handguard to pass over the gas block during handguard installation and removal.

Figure 12A:
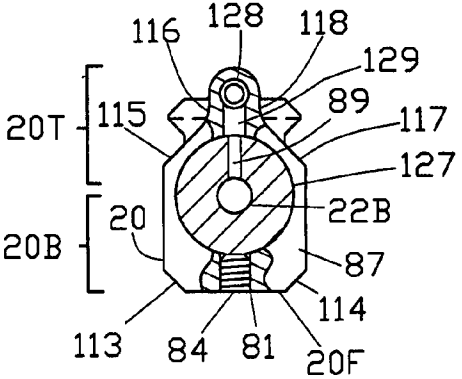
FIG. 12A is a rear end view, with broken out sections, of the gas block of FIG. 12
Figure 12C:
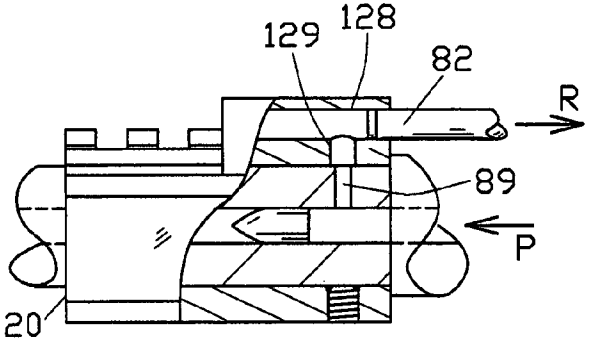
FIG. 12C is a side elevational view with broken out sections showing the block of FIG. 12 fitted with a pushrod instead of a gas tube.
Figure 12:
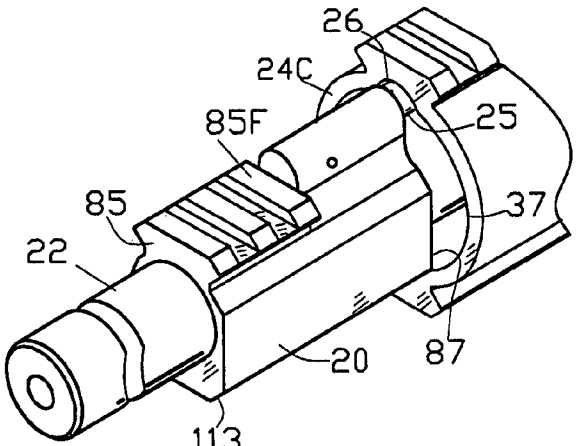
FIG. 12 is a perspective view of the low profile-integral rail gas block of application Ser. No. 11/975,881 mounted to an M16 style barrel.

FIG. 12 shows a perspective view of the improved gas block 20, barrel 22, and gas tube 25. Front portion of handguard 24C is shown encircling barrel 22 and tube 25. Block 20 includes a rear face 87 and a top rail 85. Rail 85 includes an outward face 85F.

Figure 12B:
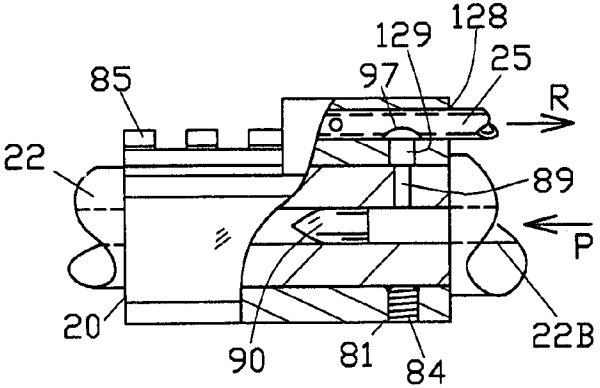
FIG. 12B is a side elevational view with broken out sections showing the block of FIG. 12.

FIGS. 12, 12B depict rail 85 disposed forward of gas tube 25 and forward of a tube bore or second longitudinal bore 128, the forward location allowing rail 85 to lie close to barrel 22, unlike prior art rail blocks which have the rail lying outward of gas tube 25. Rail face 85F lies inward of the outward most portion of second bore 128. FIG. 12A is a rear end view with partial sections of the improved gas block of FIG. 12 showing rear face 87, a block top portion 20T, a bottom portion 20B, a bottom face 20F, a longitudinal first bore 127, longitudinal second bore 128, and a vertical bore 129.

Considering rear face 87, shown are upper left and right narrow portions 116 and 118, upper left and right bevels 115 and 117, lower left and right bevels 113 and 114. Bevels 113, 114 permit the passage of handguard 24C over gas block 20. Narrow portions 116, 118 and bevels 115, 117, 113, 114, extend forward, each a predetermined distance. FIG. 12A also shows a gas port 89 from a barrel bore 22B aligned with vertical bore 129.

Referring now to FIG. 12B, presented is a side view with partial sections of the improved gas block of FIG. 12, shown are barrel 22, and second bore 128 receiving gas tube 25. Gas tube 25 is shown having a gas inlet 97, inlet 97 aligned with bore 129 and port 89. Gas tube 25 is secured to gas block 20 with means such as a pin, not shown.

In FIGS. 12-12A, gas block 20 is shown secured to barrel 22 by means of a set screw 84 engaging a threaded aperture 81. Aperture 21 is disposed in bottom face 20F.

FIG. 12B also shows a projectile 90 moving forward through barrel 22. Barrel bore 22B guides projectile 90, which is propelled by cartridge combustion gas, not shown, moving forward in arrow direction P behind projectile 90. The pressurized gas travels through gas port 89, through block vertical bore 129, into second bore 128 and tube gas inlet 97 and rearward through tube 25 in direction of arrow R to receiver 23 for actuation of a firearm operating mechanism, not shown.

FIG. 12C shows block 20 with a pushrod 82 in second bore 128 instead of gas tube 25. Pressurized gas entering bore 128 moves pushrod 82 rearward, in the direction of arrow R to communicate with a firearm mechanism, not shown. Pushrods usually have associated return springs, guide bushings or similar parts, not shown, adjacent to or integrated with a gas block, such as block 20.

Figure 13:
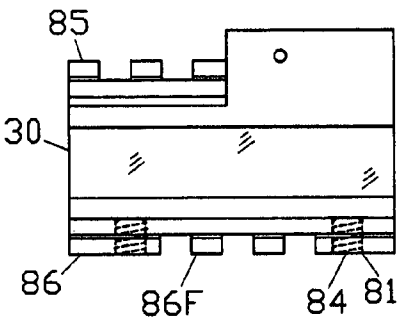
FIG. 13 is a side view of a second embodiment of a low profile-integral rail gas block having a bottom rail generally opposite the top rail.

FIG. 13 shows a side elevational view of an embodiment 30 including a second or bottom rail 86, a bottom face 86F, a pair of apertures 81, each receiving a set screw 84. Rail 86 is disposed generally opposite top rail 85. Set screws 84 engaging apertures 81 are disposed perpendicular to block bottom face 86F.

The advantages of handguard system embodiment 104 will be described in the Operation section below.

Fourth Embodiment

For system embodiment 104, the clamping process comprises three stages, as described below, compared to the two stage clamping process of embodiment 102.

Considering FIGS. 7-7A, In this embodiment, total travel of screw 40C during the three stage clamping process includes closing a gap 53 in two stages, then compressing springs 57. Gap 53 includes the clearance distance from pad upper surface 44G to nut outer diameter 60D plus the depth of groove diameter 60G.

An example of travel distances is 0.030 inch surface 44G clearance to nut diameter 60D, plus 0.030 inch depth of groove diameter 60G. Thus gap 53, in this example, is 0.060 inch. Additional screw travel required to compress springs 57, as an example is 0.040 inch, for a total screw travel of 0.100 inch.

When screw 40C travel is stopped with head 40X seated against plate 66 as shown in FIG. 7A, barrel nut 60 is firmly gripped between pad top surface 44G bearing on groove diameter 60G, and the upper portion of handguard inner diameter 37 which is in contact with nut outer diameter 60D, adjacent to nut groove 60G.

Figure 7G:
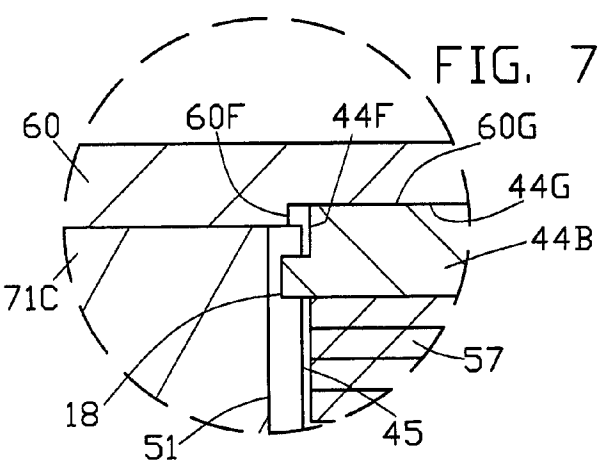
FIG. 7G is an enlarged view of FIG. 7B taken at circle 7G, showing the pad engagement with the barrel nut groove.

FIG. 7G is an enlarged view taken at circle 7G of FIG. 7B, showing pad top surface 44G engaging groove diameter 60G of barrel nut 60. Considering FIGS. 7B and 7G, forward and rear groove shoulders 60F, 60R limit the longitudinal movement of clamp pad 44 and therefore limit handguard 24C movement. Pad 44B, captured by groove 60V, serves as a redundant securing means should spring pressure be lost by damage or other cause.

Thus, system embodiment 104 has the advantages of previous embodiments, and additionally provides a redundant securing means without adding extra parts, as well as the ability to remove and replace the handguard over an integral rail-low profile gas block.

Fifth Embodiment

Figure 9:
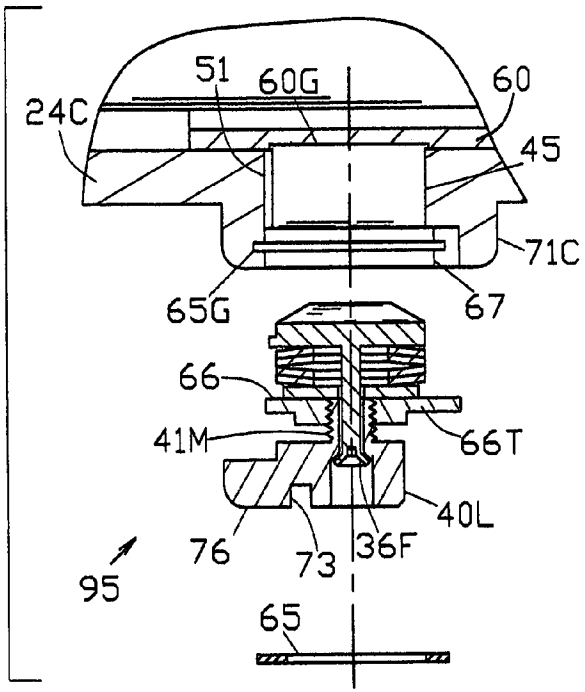
FIG. 9 is an exploded section view of another clamp device embodiment, showing an actuating screw having a lever portion.

FIG. 9 is an exploded view of showing another clamp device embodiment 95, similar to embodiment 94 except that an actuating screw 40L includes a lever portion 76 extending from a circular screw head 99 for providing multi-drive capability to clamp device 95.

Figure 9A:
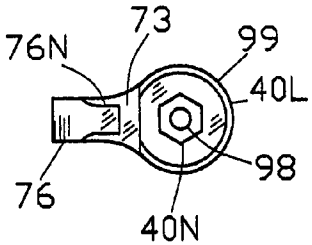
FIG. 9A is a end view of the actuating screw of FIG. 9.

FIG. 9A is an end view of actuating screw 40L showing lever portion 76, a narrow portion 76N, a notch 73, screw head 99, a through hole 98, and internal socket 40N.

Figure 9E:
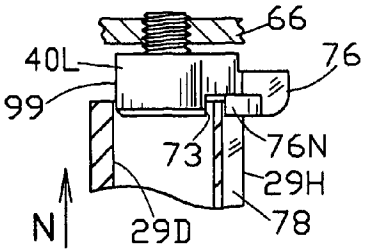
FIG. 9E is a side view with partial sections showing the hollow end of FIG. 9D engaging the lever portion of the actuating screw of FIG. 9.
Figure 9D:
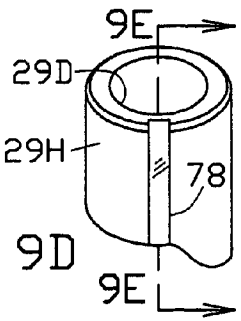
FIG. 9D is a perspective view of the hollow end of an M16 style bolt carrier assembly, the end shown in a vertical orientation.
Figure 9B:
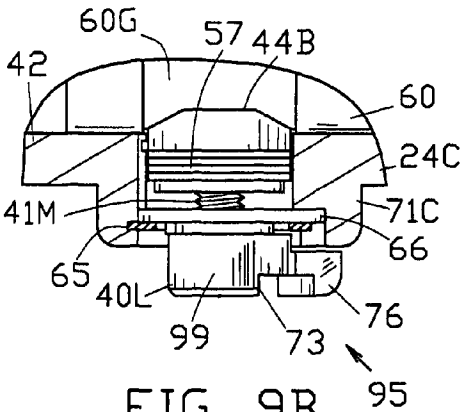
FIG. 9B is a side view with partial sections at line 9B-9B of the handguard system embodiment of FIG. 9, showing the clamp device in the clamped position.

FIG. 9B is a partial broken out view that shows clamp device 95 installed in handguard 24C. Device 95 is in the clamped position with screw thread 41M fully advanced, washers 57 deflected flat, and screw head 99 seated against plate 66. Handguard 24C and retaining ring 65 are shown in section, taken at line 9B-9B.

Figure 9C:
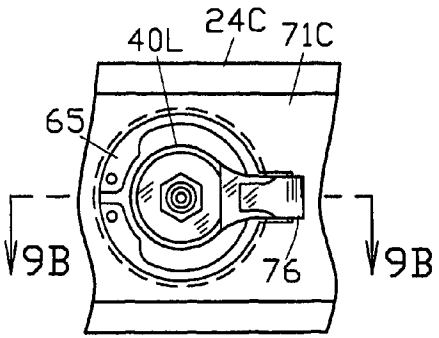
FIG. 9C shows a bottom view of the clamp device of FIG. 9B.

FIG. 9C is a bottom view of the embodiment shown in FIG. 9B showing lever portion 76 rearward and aligned with the firearm longitudinal axis when screw 40L is fully tightened and device 95 is in the clamped position.

For this alignment to occur, thread 41M of screw 40L and thread 41 of plate 66 must be timed or synchronized as part of the manufacturing process. This is readily done with modern machining equipment. Otherwise, the rotational position of lever 76 will be random with respect to the firearm longitudinal axis when head 99 of screw 40L is seated against plate 66.

Figure 14:
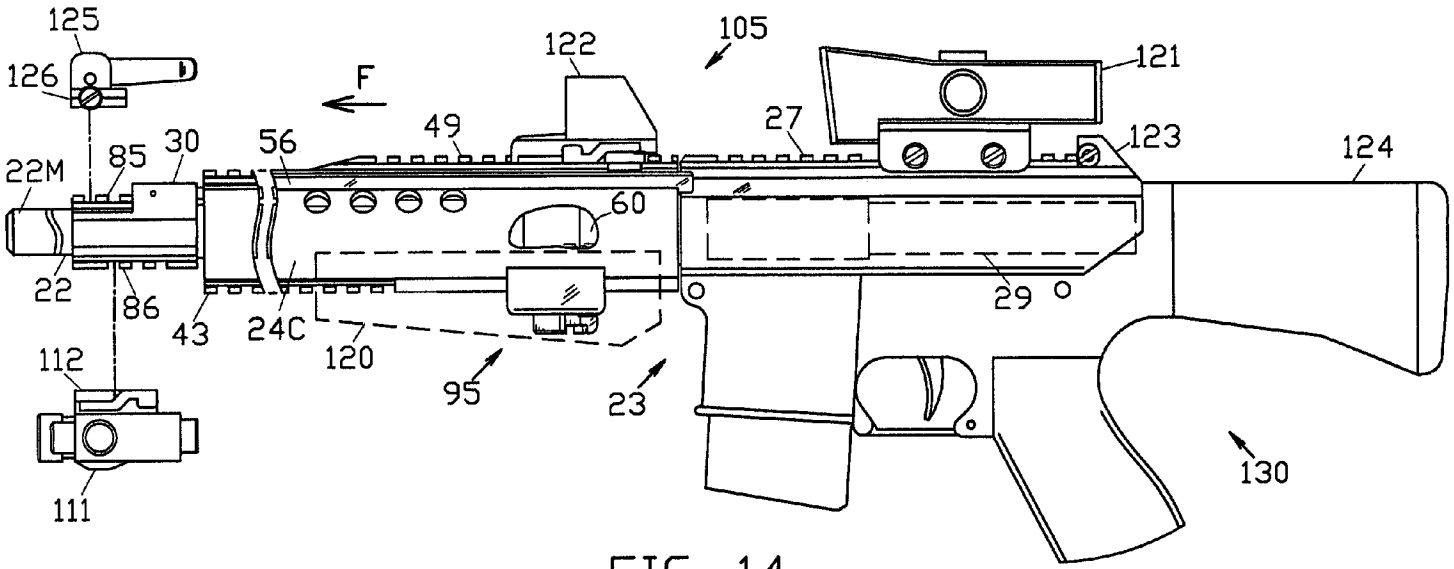
FIG. 14 is a side elevational view with partial sections of another handguard system embodiment, including the clamp device of FIG. 9B, mounted to an M16 style firearm having typical rail mounted accessories.

Referring now to FIG. 14, depicted is a typical M16 style firearm 130 with a handguard system embodiment of the present invention, generally designated 105, installed to the forward portion of firearm receiver 23. Handguard system 105 includes barrel nut 60, handguard 24C, clamp device 95 as described above, and low profile-integral rail gas block 30.

Also installed to receiver 23 are conventional rail-mountable accessories, a rear iron sight 123, and a first optic 121, each mounted to receiver rail 27.

Firearm 130 also includes barrel 22 with muzzle 22M at the barrel forward end, gas tube 25, and a rear-mounted stock 124.

Typical accessories attached to handguard system 105 are a laser sighting device 111 with lever rail clamp 112, a front iron sight 125 with a cross-bolt rail clamp 126, shown in exploded view, each to be mounted to low profile-integral rail gas block 30, a second rail-mountable optic 122 attached to top rail 49 of handguard 24C, and a rail mountable handgrip 120 (shown in phantom) attached to bottom rail 43.

The sighting devices described each have an adjustment mechanism, not shown, which allows adjustment of the sight, laterally and vertically, to agree with bullet path.

Fifth Embodiment

Regarding operation of clamp device 95, operation is the same as device embodiment 94, except that lever actuating screw 40L has multi-drive capability. Referring to FIGS. 9A-9C, this means that in addition to being tightened or driven, in a preferred method, by a hex key or hex bit engaging hex socket 40N of circular screw head 99, screw 40L may also be tightened, over a limited torque range, by thumb or finger pressure against lever portion 76.

In a third method of driving actuating screw 40L, if a hex key tool is not available, referring to FIG. 14, a conventional bolt carrier assembly 29 (shown in phantom) can be employed to engage and drive screw 40L.

Bolt carrier assembly 29 is a readily removable major component of M16 style firearms and runs generally the length of receiver 23. Now referring to FIG. 9D, shown is a hollow end 29H of bolt carrier 29, in a vertical orientation, hollow end 29H having an inside diameter 29D, and a slot 78. Diameter 29D is slightly larger than the diameter of circular screw head 99.

FIG. 9E shows bolt carrier hollow end 29H, in section view, moving in direction of arrow N and engaging the diameter of head 99. Notch 73 allows slot 78 to engage the narrow portion 76N of lever 76, for the purpose of driving and tightening or loosening actuating screw 40L.

Thus handguard system embodiment 105 has the advantages enumerated for embodiment 104 plus the added benefit of multi-drive capability for clamp device 95.

As mentioned in the Background section, when checking sight zero by firing the weapon, preferred, is not possible, firearm sighting systems may conveniently be aligned or zeroed, within a limited range, using a laser boresight, not shown, inserted in the firearm bore or chamber. Besides temporarily disabling the weapon, this method requires a dedicated laser boresight device in addition to a different rail mounted aiming laser such as laser sight 111, that may be employed on the handguard.

When system embodiment 105 is configured with a rail-mountable accessory laser sighting device 111 removably attached to low profile-integral rail gas block 30 (which is secured to barrel 22), a barrel-referenced laser zero means is thereby provided without the need for a special boresight device. Since the laser is offset from the bore centerline, the vertical and/or lateral offset will have to be considered as part of the sight aligning process.

Embodiment 105 provides the advantage of enabling the user to rapidly remove a first handguard with attached accessories, install a second handguard with accessories for the same or a different mission, and obtain a barrel-referenced laser zero (short range) without the necessity of using a special boresight or firing the weapon.

In operation, starting with a rail mountable laser sighting device which, while rail-mounted to the firearm's low profile-integral rail gas block, has previously been aligned or zeroed, by firing, to bullet path or parallel to and slightly offset from bullet path at a suitable distance:

1. A first handguard with accessories is unclamped and removed from the firearm, passing over the low profile-integral rail gas block, the gas block having no installed accessories.

2. A second handguard with accessories including sighting devices is installed and secured with the clamp device.

3. The previously aligned rail mountable laser sight is clamped to the low profile-integral rail gas block of the firearm and the firearm and laser beam spot are directed to a suitable target at the test distance. The observed laser spot represents the bullet path or a slight offset from bullet path at the test distance.

4. The sights are adjusted or checked against the observed laser spot, considering any any known offsets, such as elevation, associated with a particular sight and its mounting relative to the reference laser sight.

Alternate Construction

Figure 10:
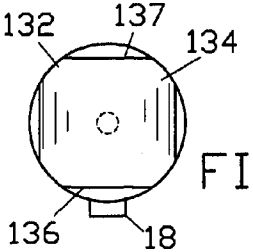
FIG. 10 is a top view of an alternate embodiment pad having flat faces at its forward and rearward edges.
Figure 10A:
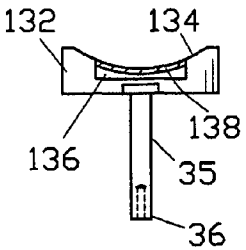
FIG. 10A is a front view of the pad of FIG. 10.

FIGS. 10 and 10A when considered together, show an alternate embodiment pad, 132. Pad 132 is similar to pad 44B in that it includes projection 18, post 35 and an upper or mating surface 134 that matches the curvature of nut groove diameter 60G.

However, pad 132 includes a forward flat surface 136 and a rear flat surface 137 each lying in a transverse vertical plane. Surfaces 136 and 137 serve to provide a larger contact area with barrel nut groove shoulders 60F, 60R shown in FIGS. 7 and 7G.

Forward flat surface 136, abutting groove shoulder 60F, prevents the loss of the handguard from the firearm in the event that some or all spring force is lost due to damage or improper tightening of the actuating screw. A forward flat contact area 138 is shown hatched in FIG. 10A.

Figure 11:
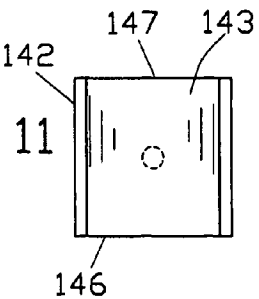
FIG. 11 is a top view of an alternate embodiment pad having a square cross section with respect to its axis of travel.
Figure 11A:
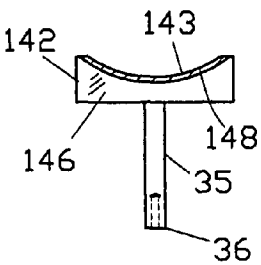
FIG. 11A is a front view of the pad of FIG. 10.

FIGS. 11 and 11A show another alternate embodiment pad, 142. Pad 142 is similar to pad 44B in that it includes an curved or mating top surface 143 that matches the curvature of nut groove diameter 60G.

However, pad 142 has square cross-section with respect to its axis of travel, whereas the cross-section of pad 44B is circular in section. Pad 142 has a forward face 146 and a rear face 147 each lying in a transverse vertical plane. Faces 146 and 147 serve to provide a larger contact area with barrel nut groove shoulders 60F, 60R shown in FIGS. 7 and 7G.

Forward pad face 146 abutting groove shoulder 60F prevents the loss of the handguard from the firearm in the event that some or all spring force is lost due to damage or improper tightening of the actuating screw. A forward face contact area 148 is shown hatched in FIG. 11A.

Pad 142 has the advantage that projection 18 is not required to orient pad 142, but a square-section handguard aperture, not shown, is required instead of round bore 45 used in conjunction with circular or disk-shaped pad 44B.

Figure 15C:
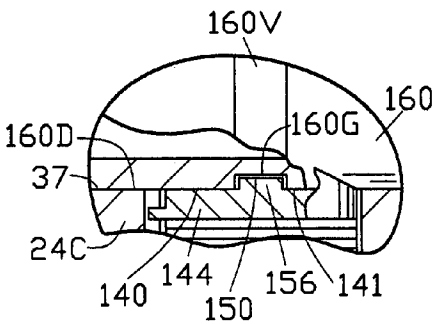
FIG. 15C is a side elevational view, with broken out sections, of the pad of FIG. 15, in the clamped position, engaging an alternate embodiment barrel nut.
Figure 15B:
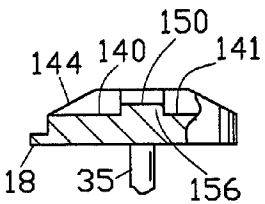
FIG. 15B is a side elevational view with a broken out section of the pad of FIG. 15.
Figure 15A:
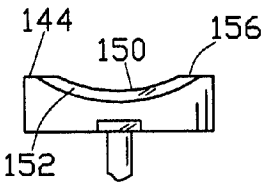
FIG. 15A is a front end view of the pad of FIG. 15.
Figure 15:
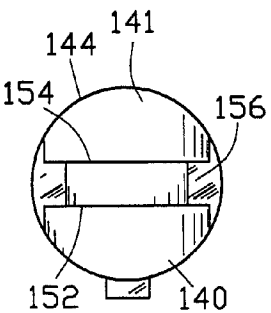
FIG. 15 is a top plan view of an alternate pad embodiment having a transverse rib portion.

FIGS. 15, 15A and 15B show another alternate embodiment pad 144 and a mating barrel nut 160. Pad 144 includes a forward and a rear top surface 140, 141 (that matches the curvature of nut 160 outside diameter), projection 18, and post 35. Barrel nut 160 includes an outside diameter 160D and a groove 160V with a groove diameter 160G.

Groove 160V is aligned longitudinally with pad 144.

Pad 144 further has a transverse rib 156 projecting a predetermined distance upward, and separating forward and rear upper surfaces 140, 141. Rib 156 has a top surface 150 with a curvature to mate with groove diameter 160G, and a rib width slightly smaller than the width of groove 160V.

In practice, a small gap would exist, as shown in FIG. 15C, between rib surface 150 and groove diameter 160G to ensure that clamping force is applied by pad surfaces 140, 141 to nut outer diameter 160D, as it is difficult to mate offset surfaces.

When pad 144 is at the fully advanced, or clamped position as shown in FIG. 15C, rib 156 is captured by groove 160G. Thus, groove 160G prevents the loss of the handguard from the firearm in the event that some or all spring force is lost due to damage or improper tightening of the clamp actuating screw.

The narrow width of groove 160V compared to groove 60V of clamp embodiment 95 provides a greater outer surface area of barrel nut 160 for contacting handguard inner diameter 37.

Pad 144 provides both clamping and latching functions with one actuation means.

CONCLUSIONS, RAMIFICATIONS AND SCOPE

Accordingly, the reader will see that, according to the invention, provided are embodiments of a handguard system with clamp device that overcome several disadvantages of the prior art, in the following manner:

(1) The handguard with clamp device of the present invention grips the barrel nut in a low stress, low wear configuration.

(2) A spring loaded clamp maintains grip during high heat, thermal expansion conditions.

(3) A positive clamp stop limits over-tightening the clamp device.

(4) A clamp pad engaging a barrel nut groove provides a redundant securing means without adding extra parts.

(5) A low profile-integral rail gas block allows rapid removal and replacement of a handguard including its complement of accessories.

(6) With a removable laser sighting device attached to the low profile-integral rail gas block, firearm sighting devices may be checked for zero without firing or temporarily disabling the firearm as occurs when using a bore inserted laser device.

While the above description contains many specific details, these should not be considered as limitations, but rather as examples of presently preferred embodiments.

For example, the post portion of the clamp pad, instead of being an integral portion of the clamp pad which is flared at its outward end as described in Operations, could be a separate headed pin, staked or otherwise attached to the pad as an alternate method of creating a unitized sub assembly of the clamp device parts.

In another example, U.S. Pat. No. 5,412,415 to Krieger discloses a two-part barrel nut assembly which permits a wide variety of nut cross-sectional shapes in addition to the circular shape depicted in the embodiment examples herein. Thus, a mating handguard to fit the outside surface of a two piece nut with a trapezoidal cross-section, as an example, would have a mating interior cross-section with a trapezoidal shape. In this case, a clamp device of the present invention mounted to such a handguard, as an example, would employ a clamp pad with a flat upper surface instead of curved, to mate with a flat portion of the trapezoidal shaped barrel nut.

Accordingly, the scope of the invention should be limited not by the embodiments, but by the appended claims and their legal equivalents.

I claim:

1. A handguard system for use on a firearm having a receiver, a barrel, and an operating member, the barrel and operating member joined to the receiver, the operating member offset from the barrel, the handguard system comprising:

a barrel nut being a unitary member, having an inner surface with a threaded portion adapted to threadably engage the receiver for securing the barrel to the receiver and an outer surface, said outer surface disposed to pass between the firearm barrel and said operating member; and a unitary tubular handguard having a rear end, an inside surface, and an outside surface, the tubular handguard surrounding the barrel, operating member and barrel nut, engaging the outer surface of said barrel nut, the handguard inner surface further including a longitudinal groove for providing clearance to said firearm operating member; and a clamp device comprising an actuating screw, a plate for mounting said clamp device to said handguard, and a clamp pad; and the actuating screw includes a head and an opposing screw end, the head having wrenching means, the screw having an external screw thread; and the plate including a plate screw thread and means for attaching said plate to said handguard; and the handguard outside surface further including a clamp bore for receiving the clamp device, the bore generally opposite said longitudinal groove and near the handguard end, the handguard further having means for securing said plate to said handguard;

and said plate screw thread aligned coaxially with said clamp bore; and said clamp pad having a top surface with a curvature matching the curvature of the barrel nut mating outer surface, the pad having an opposing flat bottom surface, said bottom surface facing the plate and abutting said screw end; and said pad further having a cross-sectional shape, relative to axis of said bore, adapted to both orient said pad top surface to said barrel nut outer surface, and permit said pad to travel within said bore; whereby, said clamp pad, forced by said actuating screw, engaging and applying clamping force to said barrel nut outer surface when said actuating screw is advanced and tightened;

and the barrel nut outer surface is gripped between said clamp pad and the opposing handguard inner surface, thus securing said handguard to said firearm.

2. A handguard system as recited in claim 1 wherein;

the firearm operating member is a gas tube.

3. A handguard system as recited in claim 2 further comprising:

in the clamp device, a spring, said spring interposed between said actuating screw end and said clamp pad bottom surface.

4. A handguard system as recited in claim 3 further including;

the clamp pad of the clamp device having a post, said post extending from the bottom surface of said clamp pad and having a hollow end; and said actuating screw further having a through-hole, the through-hole coaxial with said screw threads and adapted to receive said post, said post extending through said screw, beyond the length of the screw through-hole; and said post hollow end re-shaped and enlarged to retain said actuating screw to said post, while permitting rotation of said screw about said post; whereby, said clamp pad and said actuating screw are retained to each other.

5. A handguard system as recited in claim 4 wherein:

the barrel nut outer surface has an annular groove, the groove both aligned with, and adapted to receive the clamp pad; and the annular groove having a groove diameter, said groove diameter creating forward and rear groove shoulders; and the clamp pad includes a top surface with a groove diameter mating curvature; and said pad, when urged by said spring, the spring when forced by tightening of said actuating screw, said clamp pad engaging and applying clamping force to the barrel nut groove surface;

whereby, the barrel nut is gripped between said clamp pad, engaging said groove diameter, and the opposing handguard inner surface engaging the barrel nut outer surface; and said clamp pad and said handguard longitudinal movement is further limited by said barrel nut forward and rear groove shoulders engaging said clamp pad.

6. A handguard system as recited in claim 3 further comprising:

said clamp device actuating screw includes a screw head having an adjustment screw, the axis of said adjustment screw parallel to the axis of said actuating screw; and said adjustment screw being disposed to adjustably protrude from said actuating screw head toward said clamp device plate, for stopping advance of said actuating screw when contacting said plate; and said adjustment screw secured at desired protrusion from said screw head by means such as a locking helicoil insert;

whereby, advance of said actuating screw is adjustable, thus deflection of said spring is adjustable, thus applied force to said clamp pad is adjustable.

7. A handguard system as recited in claim 3 further comprising:

said firearm receiver further including a forward face, and a receiver rail, the rail having left and right rail walls; and a rib formed on said hanguard outer surface, the rib aligned with said clearance groove, said rib extending forward from said handguard rear end and formed into a dovetail rail, the rib further extending slightly rearward from said handguard rear end and formed into a pair of left and right projections; and the projections each having a shorter pad portion, said pads abutting said receiver forward face, for longitudinally locating said handguard on said barrel nut, said projections each having an inward facing flat surface, said flat surfaces abutting said receiver rail walls for preventing rotation of said handguard relative to said receiver; and said screw head of said clamp device actuating screw including a lever portion.

8. A handguard system as recited in claim 7 further comprising:

a gas block, the gas block being a unitary part having a rear face, the rear face having a first longitudinal bore extending forward through the block for receiving the firearm barrel and a second longitudinal bore, offset above the first and extending forward for receiving the firearm gas tube, the block further including a vertical bore connecting the two longitudinal bores, the vertical bore adapted to receive gas from a barrel gas port and convey said gas to said second longitudinal bore, the block having a bottom portion including means for securing said block to said firearm barrel, and a top portion, said top portion including the second bore and a dovetail rail, the rail located forward of the second bore and including an outward face, the forward location permitting the rail to locate adjacent the first bore, close to the barrel; and said handguard clearance groove is adapted to provide clearance to both said gas tube and said gas block; whereby, accessories can be removably rail-mounted close to the barrel, improving firearm handling; and a firearm handguard, including its complement of accessories, can be removed quickly, passing over the gas block, without the need to remove the gas block from the firearm barrel.

9. A handguard system as recited in claim 8 further comprising:

at least one sighting device mounted to said handguard rail; and a rail mountable laser sighting device, said laser sighting device mounted to said gas block integral rail; whereby, the laser beam of the gas block mounted laser sighting device may be used as a barrel-referenced bullet path indication for verifying alignment of the handguard-mounted sighting device without firing the firearm; and with the rail mounted laser sighting device removed from the gas block, the handguard with attached sighting device can quickly be removed from the firearm by unclamping the clamp device and sliding the handguard forward, passing over the gas block; and the same handguard or a similar handguard may be quickly installed, engaging said barrel nut and securing said handguard with said clamp device; and with the laser sighting device re-installed to said gas block, the sight alignment verification process may be repeated.

10. A handguard system as recited claim 3 further comprising:

a thrust washer, said thrust washer interposed between said actuating screw end and said spring; whereby force is transmitted from the actuating screw to said spring.

11. A handguard system as recited in claim 3 wherein:

the pad of said clamp device includes a projection, the projection extending radially outward from said pad; and the handguard including a slot, the slot located adjacent to said clamp bore and running from the handguard outer surface parallel to said clamp bore and stopping short of the handguard inner surface, the slot adapted to receive the pad projection; and the slot and pad projection cooperating and adapted to both orient the pad top surface within the clamp bore, relative to the barrel nut outer surface, and limit the upward travel of the pad; whereby, the pad top surface is oriented to mate with said barrel nut outer surface; and said slot, cooperating with said pad projection, retains said pad within said clamp bore when said handguard is removed from said barrel nut.

12. A handguard system as recited in claim 11 further including:

the clamp device includes a post, the post extending from the bottom surface of said clamp pad and having a hollow end; and said actuating screw further having a through-hole, the hole coaxial with said screw threads and adapted to receive said post at said screw, said post extending through said screw, beyond the length of the screw through-hole; and said post hollow end re-shaped and enlarged to retain said actuating screw to said post, while permitting rotation of said screw about said post; whereby, said clamp pad and said actuating screw are linked to each other.

13. A handguard system as recited in claim 2 wherein:

the firearm operating member is a pushrod.

14. A handguard system as recited in claim 13 further comprising:

in the clamp device, a spring, said spring interposed between said actuating screw end and said clamp pad bottom surface.

15. A handguard system as recited in claim 14 wherein:

the pad of said clamp device includes a projection, the projection extending radially outward from said pad; and the handguard including a slot, the slot adapted to receive said pad projection, the slot located adjacent to said clamp bore and running from the handguard outer surface, parallel to said clamp bore and stopping short of the handguard inner surface, the slot adapted to receive the pad projection; and the slot and pad projection cooperating and adapted to both orient the pad top surface within the clamp bore, relative to the barrel nut outer surface, and limit the upward travel of the pad; whereby, the pad top surface is oriented to mate with said barrel nut outer surface; and said slot, cooperating with said pad projection, retains said pad within said clamp bore when said handguard is removed from said barrel nut.

16. A handguard system as recited in claim 15 further including:

the clamp device includes a post, the post extending from the bottom surface of said clamp pad; and the clamp device includes a post, the post extending from the bottom surface of said clamp pad and having a hollow end; and said actuating screw further having a through-hole, the through-hole coaxial with said screw threads and adapted to receive said post at said screw, said post extending through said screw, beyond the length of the screw through-hole; and said post hollow end re-shaped and enlarged to retain said actuating screw to said post, while permitting rotation of said screw about said post; whereby, said clamp pad and said actuating screw are linked to each other.

17. A handguard system as recited in claim 14 further including;

the clamp pad of the clamp device having a post, said post extending from the bottom surface of said clamp pad and having a hollow end; and said actuating screw further having a through-hole, the through-hole coaxial with said screw threads and adapted to receive said post, said post extending through said screw, beyond the length of the screw through-hole; and said post hollow end re-shaped and enlarged to retain said actuating screw to said post, while permitting rotation of said screw about said post; whereby, said clamp pad and said actuating screw are retained to each other.

18. A handguard system as recited in claim 17 wherein:

the barrel nut outer surface has an annular groove, the groove both aligned with, and adapted to receive the clamp pad; and the annular groove having a groove diameter, said groove diameter creating forward and rear groove shoulders; and the clamp pad includes a top surface with a groove diameter mating curvature; and said pad, when urged by said spring, the spring when forced by tightening of said actuating screw, said clamp pad engaging and applying clamping force to the barrel nut groove surface;

whereby, the barrel nut is gripped between said clamp pad, engaging said groove diameter, and the opposing handguard inner surface engaging the barrel nut outer surface; and said clamp pad and said handguard longitudinal movement is further limited by said barrel nut forward and rear groove shoulders engaging said clamp pad.

19. A handguard system as recited in claim 14 further comprising:

said clamp device actuating screw including a screw head having an adjustment screw, the axis of said adjustment screw parallel to the axis of said actuating screw; and said adjustment screw being disposed to adjustably protrude from said actuating screw head toward said clamp device plate, for adjustably stopping advance of said actuating screw by contacting said plate; and said adjustment screw being secured at desired protrusion from said screw head by means such as a locking helicoil insert;

whereby, advance of said actuating screw is adjustable, thus deflection of said spring is adjustable, thus applied force to said clamp pad is adjustable.

20. A handguard system as recited in claim 14 further including:

said firearm receiver further including a forward face, and a receiver rail, the rail having left and right rail walls; and a rib formed on said hanguard outer surface, the rib aligned with said clearance groove, said rib extending forward from said handguard rear end and formed into a dovetail rail, the rib further extending slightly rearward from said handguard rear end and formed into a pair of left and right projections; and the projections each having a shorter pad portion, said pads abutting said receiver forward face, for longitudinally locating said handguard on said barrel nut, said projections each having an inward facing flat surface, said flat surfaces abutting said receiver rail walls for preventing rotation of said handguard relative to said receiver; and said screw head of said clamp device actuating screw including a lever portion.

21. A handguard system as recited in claim 20 further comprising:

a gas block, the gas block being a unitary part having a rear face, the rear face having a first longitudinal bore extending forward through the block for receiving the firearm barrel and a second longitudinal bore, offset above the first and extending forward for receiving the firearm gas tube, the block further including a vertical bore connecting the two longitudinal bores, the vertical bore adapted to receive gas from a barrel gas port and convey said gas to said second longitudinal bore, the block having a bottom portion including means for securing said block to said firearm barrel, and a top portion, said top portion including the second bore and a dovetail rail, the rail located forward of the second bore and including an outward face, the forward location permitting the rail to locate adjacent the first bore, close to the barrel; and said handguard clearance groove is adapted to provide clearance to both said gas tube and said gas block; whereby, accessories can be removably rail-mounted close to the barrel, improving firearm handling; and a firearm handguard, including its complement of accessories, can be removed quickly, passing over the gas block, without the need to remove the gas block from the firearm barrel.

22. A handguard system as recited in claim 21 further comprising:

at least one sighting device mounted to said handguard rail; and a rail mountable laser sighting device, said laser sighting device mounted to said gas block integral rail; whereby, the laser beam of the gas block mounted laser sighting device may be used as a barrel-referenced bullet path indication for verifying alignment of the handguard-mounted sighting device without firing the firearm; and with the rail mounted laser sighting device removed from the gas block, the handguard with attached sighting device can quickly be removed from the firearm by unclamping the clamp device and sliding the handguard forward, passing over the gas block; and the same handguard or a similar handguard may be quickly installed, engaging said barrel nut and securing said handguard with said clamp device; and with the laser sighting device re-installed to said gas block, the sight alignment verification process may be repeated.

23. A handguard system as recited claim 14 further comprising:

a thrust washer, said thrust washer interposed between said actuating screw end and said spring; whereby, force is transmitted from said actuating screw to said spring.

24. A clamp device for securing a handguard to a firearm, the firearm having minimally a receiver, a barrel, a barrel nut and a tubular handguard, the barrel nut having an inner threaded surface for securing the barrel to the receiver, and an outer surface, the tubular handguard having an inner surface for engaging the barrel nut outer surface, the firearm handguard further having a clamp bore for receiving a clamp device, the clamp device comprising:

an actuating screw, a plate for mounting said clamp device to said handguard, and a clamp pad, the actuating screw including an external screw thread, a head and an opposing screw end, the head having wrenching means; and the plate including a plate screw thread, the plate screw thread aligned with the clamp bore, the plate including means for attaching said plate to the firearm handguard; and said clamp pad having a top surface with a curvature matching the curvature of the barrel nut outer surface, the pad having an opposing flat bottom surface, said bottom surface facing the plate and abutting said screw end; and said pad further having a cross-sectional shape, relative to axis of said bore, adapted to both orient said pad top surface with said barrel nut outer surface, and permit said pad to slidably travel within said bore; whereby, said clamp pad, forced by said actuating screw, engaging and applying clamping force to said barrel nut outer surface when said actuating screw is advanced and tightened; and the firearm barrel nut outer surface is gripped between said clamp pad top surface and the opposing handguard inner surface, thus securing said handguard to said firearm.

25. A clamp device as recited in claim 24 the clamp device further comprising:

a spring, the spring interposed between said actuating screw end and said clamp pad bottom surface.

26. A clamp device as recited in claim 24 wherein:

said firearm barrel nut outer surface includes an annular groove, with a groove diameter, the groove adapted to receive said clamp pad; and the clamp pad top surface has a curvature matching the diameter of said annular groove; whereby, said clamp pad, forced by said actuating screw, engaging and applying clamping force to said barrel nut outer surface when said actuating screw is advanced and tightened; and said barrel nut is gripped between said clamp pad top surface engaging said groove diameter and the opposing handguard inner surface, thus securing said handguard to said firearm, the clamp device and the attached handguard longitudinal movement further limited by said pad engaging said groove.

27. A clamp device as recited in claim 24 wherein:

said firearm barrel nut outer surface includes an annular groove; and the clamp pad top surface includes a protruding transverse rib, the rib having a curved top surface which matches the curvature of the annular groove, the rib aligned with and adapted to be received by said groove, the rib having slight clearance to said annular groove when said pad top surface is engaging said firearm barrel nut outer surface; whereby, said clamp pad, forced by said actuating screw, engaging and applying clamping force to said barrel nut outer surface when said actuating screw is advanced and tightened; and the barrel nut outer surface is gripped between said clamp pad top surface and the opposing handguard inner surface, thus securing said handguard to said firearm, said clamp device and the attached handguard longitudinal movement further limited by said rib being received by said barrel nut groove.

* * * * *